US012366377B2

(12) United States Patent
Deng et al.

(10) Patent No.: US 12,366,377 B2
(45) Date of Patent: Jul. 22, 2025

(54) PANEL ASSEMBLY AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Jingwen Deng, Guangdong (CN); Eli Zhao, Guangdong (CN); Fashen Liu, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 323 days.

(21) Appl. No.: 18/098,227

(22) Filed: Jan. 18, 2023

(65) Prior Publication Data

US 2023/0152001 A1 May 18, 2023

Related U.S. Application Data

(63) Continuation of application No. PCT/CN2021/084663, filed on Mar. 31, 2021.

(30) Foreign Application Priority Data

Jul. 27, 2020 (CN) ..... 202010731733.8
Jul. 27, 2020 (CN) ..... 202021512730.7
(Continued)

(51) Int. Cl.
*F24F 13/20* (2006.01)
*F24F 11/52* (2018.01)
*F24F 13/06* (2006.01)

(52) U.S. Cl.
CPC ..... *F24F 13/20* (2013.01); *F24F 11/52* (2018.01); *F24F 13/06* (2013.01)

(58) Field of Classification Search
CPC ..... F24F 13/20; F24F 11/52; F24F 13/06
See application file for complete search history.

(56) References Cited

U.S. PATENT DOCUMENTS

2020/0187376 A1* 6/2020 Jun ..... H05K 5/0217

FOREIGN PATENT DOCUMENTS

CN 101377048 A 3/2009
CN 203704062 U 7/2014
(Continued)

OTHER PUBLICATIONS

Peishi et al., Key Water-Proof Structure of Washing Machine, Mar. 4, 2009, CN101377048A, Whole Document (Year: 2009).*
(Continued)

*Primary Examiner* — Larry L Furdge
(74) *Attorney, Agent, or Firm* — Scully, Scott, Murphy & Presser, P.C.

(57) ABSTRACT

Provided are a panel assembly and an air conditioner. The panel assembly includes a panel, a pressing member, and a display box. The panel has a fitting hole. The pressing member is disposed on an inner side of the panel. The pressing member includes a plate body, and a button disposed on the plate body and extending into the fitting hole. The display box is disposed on a back surface of the panel and opposite to the pressing member. The plate body has a flow diverting portion disposed around the button and configured to divert a fluid out of the display box.

20 Claims, 16 Drawing Sheets

(30) Foreign Application Priority Data

Nov. 11, 2020 (CN) ..... 202022605534.0
Mar. 29, 2021 (CN) ..... 202120634864.4

(56) References Cited

FOREIGN PATENT DOCUMENTS

| | | | |
|---|---|---|---|
| CN | 104185391 | A | 12/2014 |
| CN | 108361957 | A | 8/2018 |
| CN | 207947189 | U | 10/2018 |
| CN | 110804839 | A | 2/2020 |
| CN | 212746876 | U | 3/2021 |
| KR | 101644358 | B1 | 8/2016 |

OTHER PUBLICATIONS

International Search Report dated Jun. 30, 2021 issued in PCT/CN2021/084663.
Office Action dated Mar. 1, 2025 received in Chinese Patent Application No. 202010731733.8.

* cited by examiner

PANEL ASSEMBLY AND AIR CONDITIONER

CROSS-REFERENCE TO RELATED APPLICATIONS

The present application is a continuation of International Application No. PCT/CN2021/084663, filed on Mar. 31, 2021, which claims priorities to Chinese Patent Applications No. 202010731733.8 filed on Jul. 27, 2020, No. 202021512730.7 filed on Jul. 27, 2020, No. 202022605534.0 filed on Nov. 11, 2020, and No. 202120634864.4 filed on Mar. 29, 2021, the entire contents of each of which are incorporated herein by reference for all purposes. No new matter has been introduced.

FIELD

The present disclosure relates to the field of air conditioning technologies, and more particularly, to a panel assembly and an air conditioner having the panel assembly.

BACKGROUND

In the related art, a display module of some mobile air conditioners typically uses a hard plastic button, such as a tact switch button. The hard plastic button has an uncomfortable hand feeling. In addition, when assembled into the display module, the plastic button is usually in a clearance fit with a display box of the display module to prevent the plastic button from being jammed Consequently, the sealing of the display module is unsatisfactory, and thus the display module is prone to an ingress of water, ash, or the like.

SUMMARY

One object of the present disclosure is to at least provide a panel assembly having a flow diverting portion disposed around a button thereof, which can improve stability and safety of display and operation.

Another object of the present disclosure is to at least provide an air conditioner having the panel assembly.

The panel assembly according to an embodiment of the present disclosure includes a panel, a pressing member, and a display box. The panel has a fitting hole. The pressing member is disposed on an inner side of the panel, and includes a plate body and a button disposed on the plate body. The button extends into the fitting hole. The display box is disposed on a back surface of the panel and opposite to the pressing member. The plate body has a flow diverting portion. The flow diverting portion is disposed around the button and configured to divert a flow out of the display box.

According to the panel assembly of certain embodiments of the present disclosure, the flow diverting portion is disposed around the button, it is thus possible to realize diversion of a flow, especially a flow between the pressing member and the panel. Since the flow diverting portion is capable of diverting the flow out of the display box, the flow can be prevented from entering the display box to avoid damages to electronic components inside the display box, which effectively improves stability and safety of operation of the display box, and prolongs a lifespan of the display box.

In addition, the panel assembly according to certain embodiments of the present disclosure may also have the following additional features.

In some embodiments, the flow diverting portion is disposed on a surface of the plate body facing towards the panel, and includes a first flow diverting groove defined around the button and a second flow diverting groove in communication with the first flow diverting groove and extending to an edge of the plate body through the plate body.

In some embodiments, the surface of the plate body is partially hollowed out to define the first flow diverting groove and the second flow diverting groove.

In some embodiments, the plate body is attached to an inner surface of the panel.

In some embodiments, the panel has one or more fitting holes. One or more buttons are provided in one-to-one correspondence with the one or more fitting holes. The flow diverting portion is provided for each of the one or more buttons and disposed around each of the one or more buttons.

In some embodiments, the pressing member is formed into a flexible integrated plate shape.

In some embodiments, an accommodation groove is defined on a surface of the display box facing towards the panel, and the pressing member is embedded in the accommodation groove.

In some embodiments, one of the plate body and the display box has a positioning post, and the other one of the plate body and the display box has a positioning hole. The positioning post is inserted into the positioning hole.

In some embodiments, the display box has a display region. A part of the panel directly opposite to the display region is thinned to form a thinned region.

In some embodiments, a limiting rib is disposed on the panel and abuts against a side edge of the display box.

In some embodiments, the plate body includes a first plate portion, a connection portion, and a second plate portion that are connected sequentially in a length direction of the plate body. The display box has a first recess, a communication groove portion, and a second recess that are communicated sequentially in a length direction of the display box. The first plate portion is embedded in the first recess. The second plate portion is embedded in the second recess. The connection portion is embedded in the communication groove portion.

In some embodiments, the button is disposed on each of the first plate portion and the second plate portion. The display region includes a digital display region and a lighting region. The lighting region is opposite to the button in a width direction of the plate body, and the digital display region is located between the first recess and the second recess in the length direction of the plate body.

In some embodiments, two ends of the display box in a length direction of the display box are fixedly connected to the panel, and the pressing member is fixedly clamped through engagement of the display box with the panel.

An air conditioner according to embodiments of the present disclosure includes a body and the panel assembly as described above. The panel assembly is disposed on the body.

In some embodiments, the air conditioner is a mobile air conditioner. The panel assembly is disposed on an upper part of the body. A flow guide structure is disposed in the body, and configured to guide a fluid discharged from the flow diverting portion into a predetermined position.

In some embodiments, an upper air duct assembly is disposed in the body. The upper air duct assembly includes an upper air duct heat exchanger, a scroll housing, and an upper air duct fan. The flow guide structure is disposed on the scroll housing. The upper air duct fan is disposed in the scroll housing.

In some embodiments, the flow guide structure includes a fluid receiving tank and a fluid diverting structure. The fluid receiving tank is disposed between the scroll housing and an outer wall surface of an air outlet of the upper air duct assembly, and extends in a length direction of the air outlet. The fluid receiving tank is adapted to receive the fluid discharged from the flow diverting portion, and a drainage portion is disposed on at least one end of the fluid receiving tank. The fluid diverting structure is disposed on a side wall of the scroll housing. The fluid diverting structure has an upper part configured to joint with a corresponding drainage portion and a lower part configured to divert the fluid into the predetermined position.

In some embodiments, the fluid diverting structure is configured as a fluid diverting groove and/or a flow diverting rib.

In some embodiments, the fluid diverting structure is configured to include the flow diverting rib. The flow diverting rib includes a first flow diverting segment extending obliquely towards the predetermined position relative to a horizontal plane; and/or the flow diverting rib includes a second flow diverting segment extending towards the predetermined position and a third flow diverting segment disposed on an upper end of the second diverting segment. The third flow diverting segment extends obliquely towards the second flow diverting segment relative to a horizontal plane to divert the fluid discharged from the drainage portion to the second flow diverting segment.

In some embodiments, when the flow diverting rib includes the first flow diverting segment, the second diverting segment, and the third flow diverting segment, the first flow diverting segment is disposed at a lower side of the second flow diverting segment to divert a fluid flowing through the second flow diverting segment into the predetermined position.

In some embodiments, a sealing plate is disposed on the scroll housing. The fluid receiving tank is disposed on the sealing plate, and a fluid retaining rib is disposed on the sealing plate.

In some embodiments, the air conditioner further includes a lower air duct assembly. An intermediate partition plate is disposed between the lower air duct assembly and the upper air duct assembly. The flow guide structure is configured to guide the fluid discharged from the flow diverting portion to the intermediate partition plate. The lower air duct assembly includes a lower air duct heat exchanger. The intermediate partition plate has a drainage hole located above the lower air duct heat exchanger.

Figure 1:
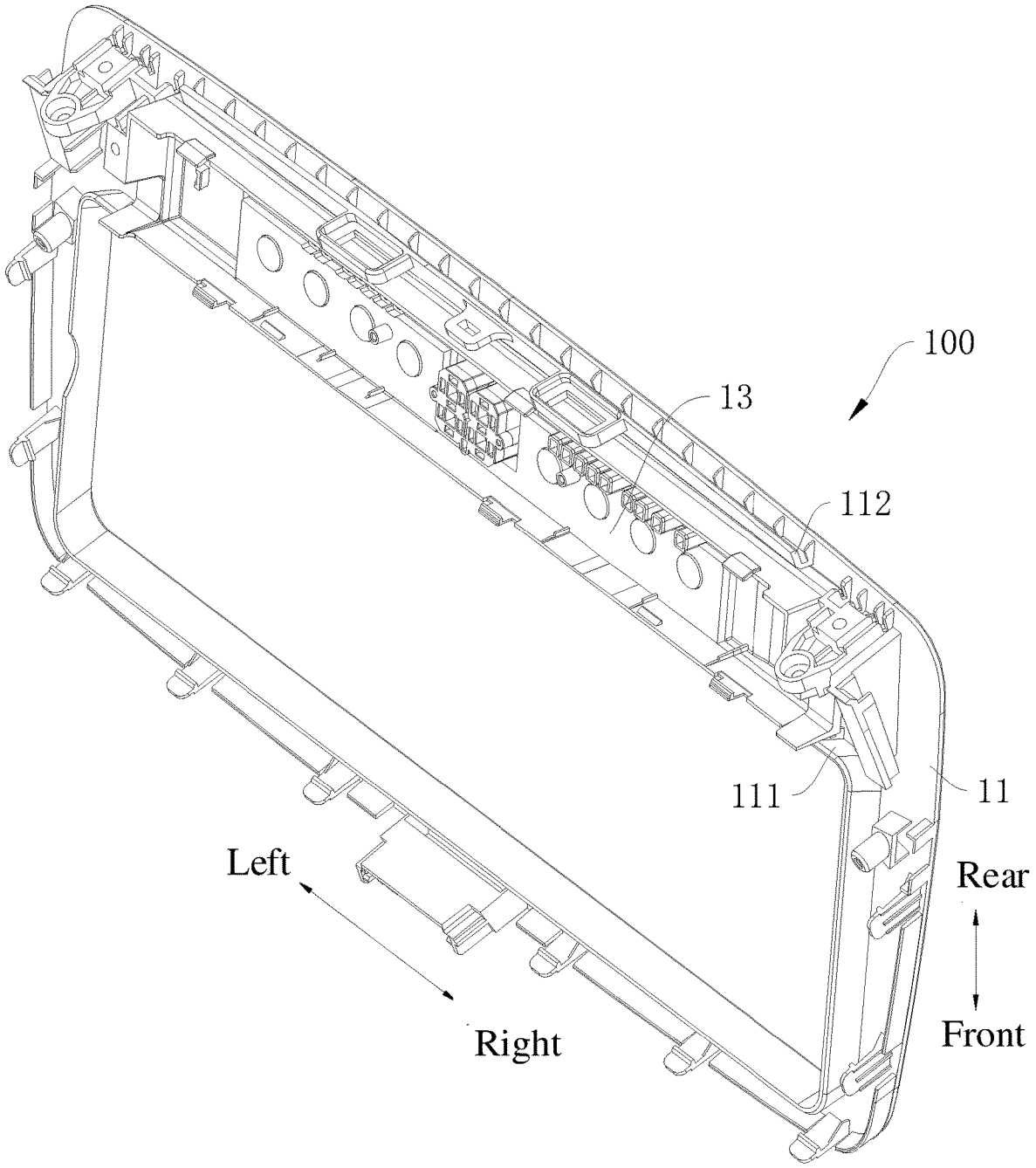
FIG. 1 is a schematic view of a panel assembly according to an embodiment of the present disclosure.
Figure 2:
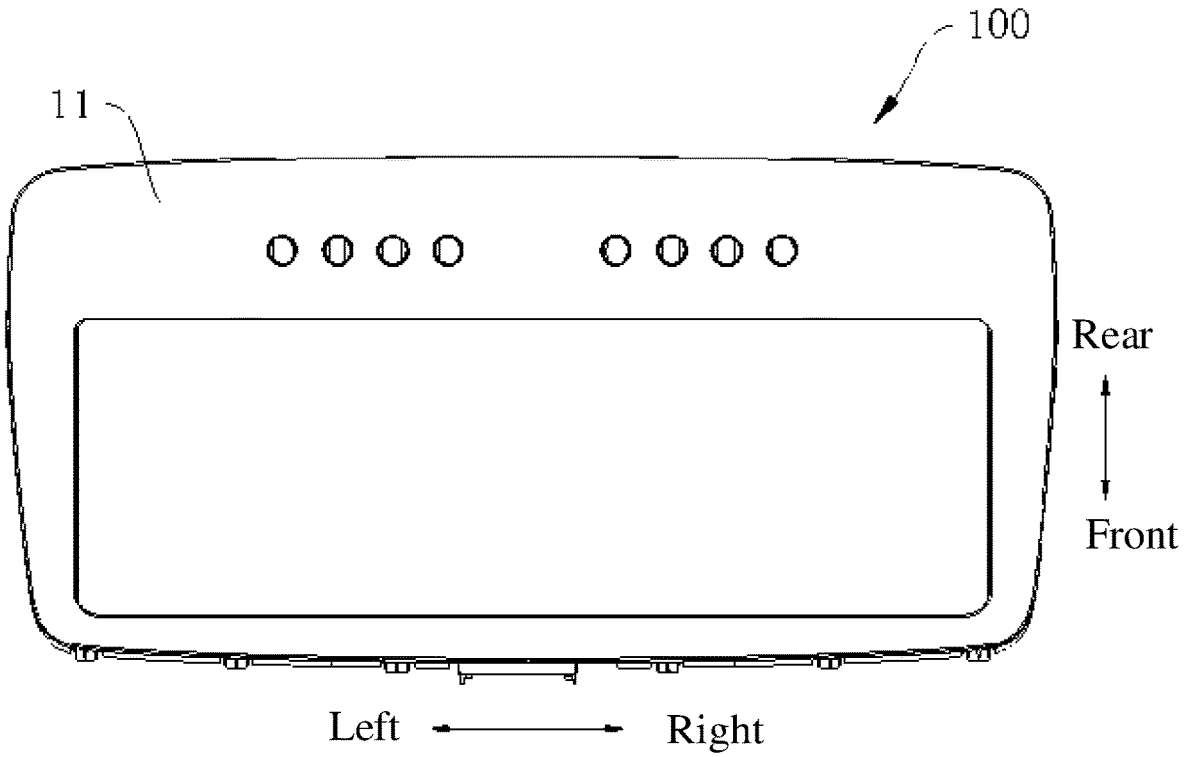
FIG. 2 is a front view of a panel assembly according to an embodiment of the present disclosure.

Reference numerals of the accompanying drawings are described as follows:

- panel assembly 100, panel 11, fitting hole 101, first rib 111, second rib 112, supporting rib 113, pressing member 12, plate body 121, button 122, flow diverting portion 123, first flow diverting groove 1231, second flow diverting groove 1232, positioning hole 102, first plate portion 1211, second plate portion 1212, connection portion 1213, display box 13, accommodation groove 103, positioning post 104, notch 105, positioning rib 131, connection sheet 132, first recess 1031, second recess 1032, communication groove portion 1033, digital display region 133, lighting region 134;
- upper air duct assembly 200, air outlet 200*a*, upper air duct heat exchanger 210, scroll housing 220, upper air duct fan 230, outer wall surface 240;
- intermediate partition plate 300, fluid receiving tray 310, drainage hole 311;
- fluid receiving tank 400, drainage portion 410;
- sealing plate 500, fluid retaining rib 510;
- fluid diverting groove 600, flow diverting rib 700, first flow diverting segment 701, second flow diverting segment 702, third flow diverting segment 703;
- lower air duct assembly 800, lower air duct heat exchanger 810, base 820, flow guide structure 900, fluid diverting structure 910.

DETAILED DESCRIPTION OF THE EMBODIMENTS

The exemplary embodiments of the present disclosure will be described in detail below with reference to examples thereof as illustrated in the accompanying drawings, throughout which same or similar elements, or elements having same or similar functions, are denoted here by same or similar reference numerals. The exemplary embodiments described below with reference to the drawings are illustrative only, and are intended to explain, rather than limiting, the present disclosure.

In connection with FIG. 1 to FIG. 7, a panel assembly 100 according to an embodiment of the present disclosure includes a panel 11, a pressing member 12, and a display box 13. The panel 11 provides an exterior surface of a device.

The pressing member 12 is disposed on the panel 11. A corresponding functional component in the display box 13 can be activated by a button 122 on the pressing member 12. The panel assembly 100 of the present disclosure can be applicable in a device, such as a refrigerator, a microwave oven, or a rice cooker, especially, an air conditioner.

Figure 3:
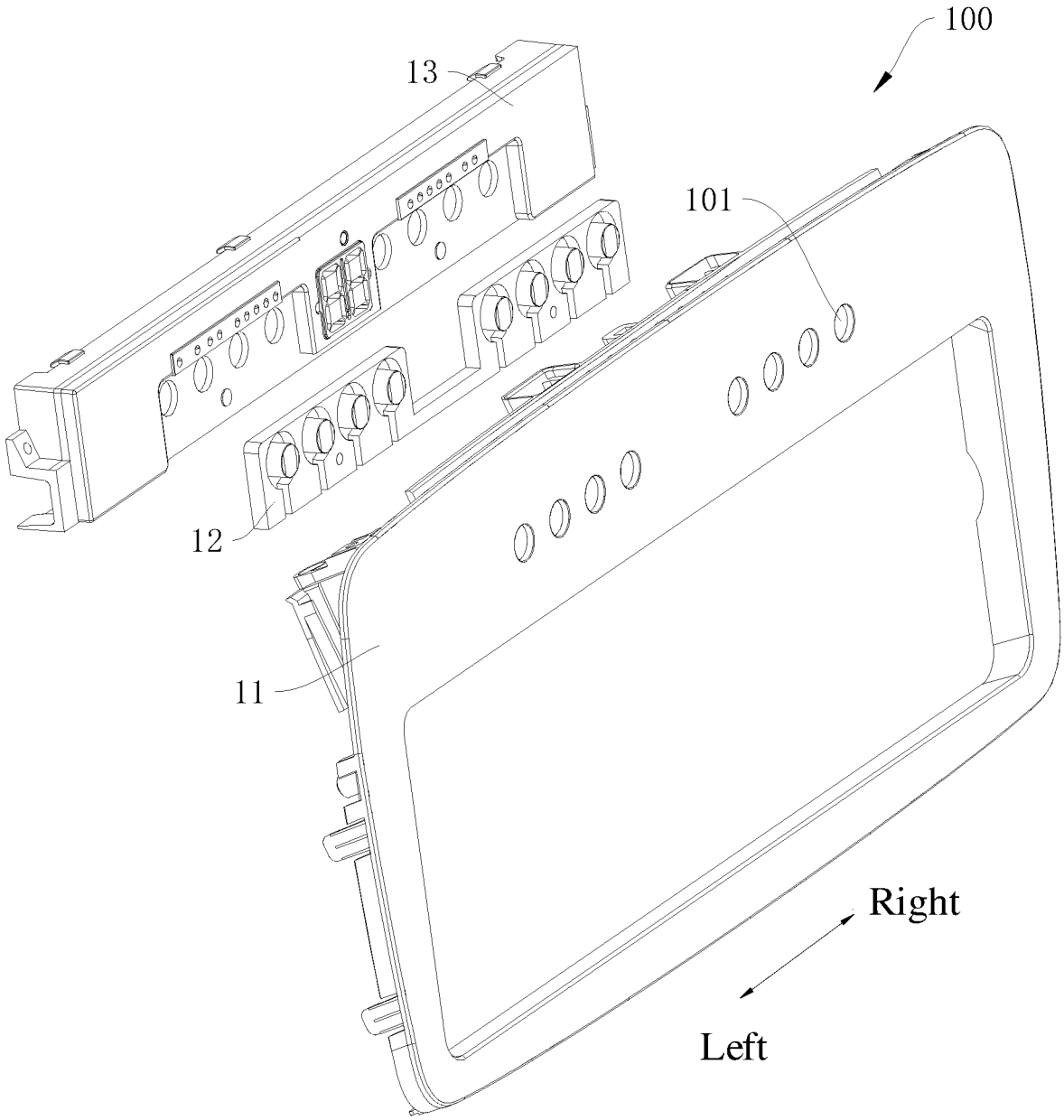
FIG. 3 is a schematic exploded view of a panel assembly according to an embodiment of the present disclosure.
Figure 6:
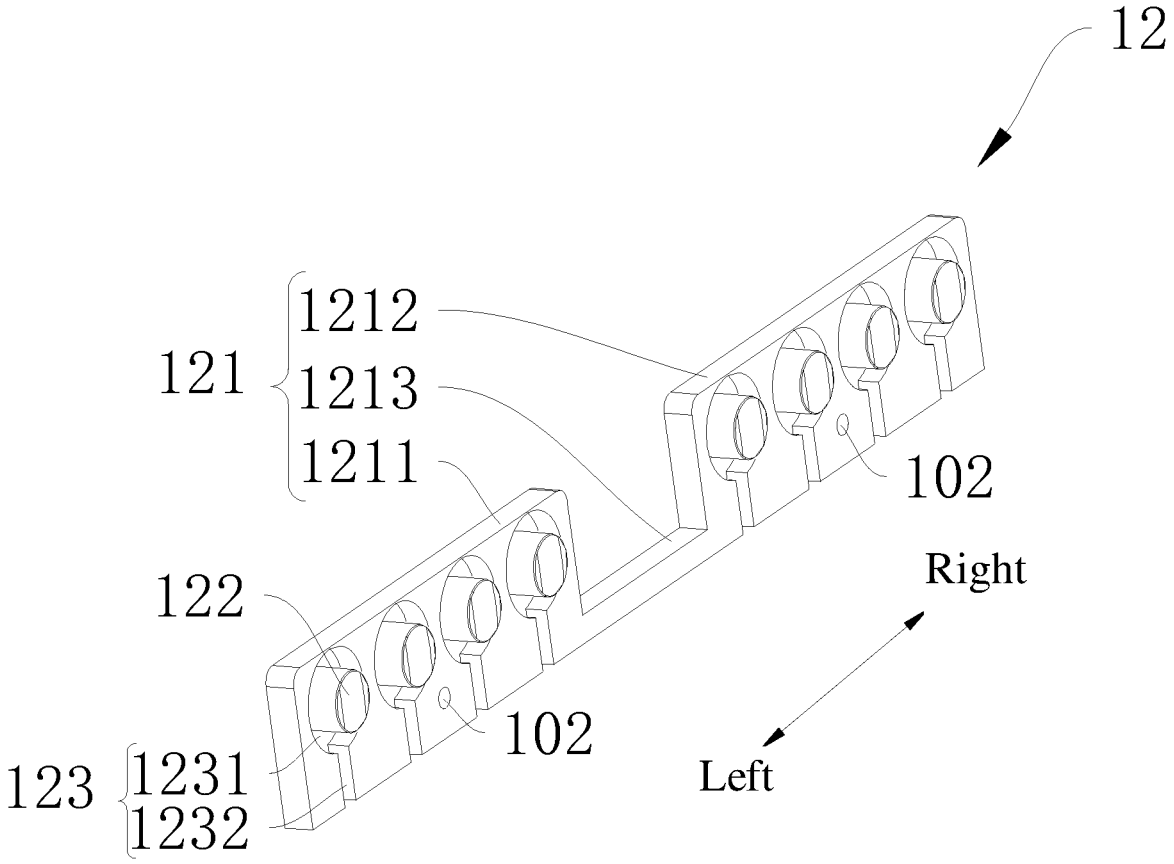
FIG. 6 is a schematic view of a pressing member of a panel assembly according to an embodiment of the present disclosure.

In some embodiments, as illustrated in FIG. 3 and FIG. 6, the panel 11 has a fitting hole 101. The pressing member 12 is disposed on an inner side of the panel 11, and includes a plate body 121 and a button 122 disposed on the plate body 121. The button 122 extends into the fitting hole 101. The display box 13 is disposed on a back surface of the panel 11 and opposite to the pressing member 12. A corresponding functional component of the display box 13 may be selected by pressing the button 122. The plate body 121 is provided with a flow diverting portion 123. The flow diverting portion 123 is disposed around the button 122 and configured to divert a fluid out of the display box 13. That is, the flow diverting portion 123 is capable of diverting a fluid entering an interior of the panel 11 to prevent the fluid entering the interior of the panel 11 from damaging the display box 13, which can effectively improve stability of the display box 13 and avoid damages to the display box 13 due to an ingress of the fluid.

With the panel assembly 100 according to certain embodiments of the present disclosure, the flow diverting portion 123 is disposed around the button 122, and it is thus possible to achieve diversion of the fluid, especially achieve diversion of a fluid between the pressing member 12 and the panel 11. Since the flow diverting portion 123 is capable of diverting the fluid out of the display box 13, it is possible to avoid damages to electronic components inside the display box 13 due to the ingress of the flow into the display box 13, which effectively improves stability and safety of operation of the display box 13 and prolongs a lifespan of the display box 13.

In addition, isolation provided by the plate body 121 can further prevent the fluid between the plate body 121 and the panel 11 from entering an interior of the display box 13, which effectively improves the safety and stability of the operation of the display box 13.

For example, in a device provided with the panel assembly 100, when there is a great amount of splattered fluid, attached fluid, or the like on an outer surface of the panel assembly 100, some fluid may enter the interior of the panel 11 through a gap between the button 122 and an inner peripheral surface of the fitting hole 101, which would affect stable operation of the display box 13. Therefore, in the present disclosure, the fluid entering the interior of the panel assembly 100 is diverted by the flow diverting portion 123 to be discharged promptly, which prevents stable operation of the display box 13 and the electronic components in the display box 13 from being affected.

In addition, the panel assembly 100 may be applied in an air conditioner, in which case it is likely to form an airflow of mixed hot and cold air at and around the panel assembly 100, especially when air is discharged through the panel assembly 100. The airflow of the mixed hot and cold air may lead to condensation of fluid vapor in the hot air, and thus condensed fluid is generated. Similarly, the flow diverting portion 123 in the present disclosure is capable of diverting the condensed fluid away from the display box 13 to avoid damages to the display box 13.

In at least one embodiment, the button 122 may extend out of the fitting hole 101 to facilitate pressing of the button 122. Further, a surface of the button 122 extending out of the fitting hole 101 may be an arc-shaped surface. For example, a peripheral edge of an end surface of the button 122 may be flush with a peripheral edge of the fitting hole 101, while a middle part of the end surface of the button 122 bulges.

The flow diverting portion 123 in the present disclosure may have many different forms. For example, a sufficiently large gap may be formed between the plate body 121 and the panel 11. In some embodiments, when a small gap is formed between the plate body 121 and the panel 11, the fluid between the plate body 121 and the panel 11 may be retained due to adsorption, which would increase the risk of the damage to the display box 13 due to the fluid entering the interior of the panel 11. For this reason, in the present disclosure, the pressing member 12 may be spaced apart from the panel 11 to form the flow diverting portion 123, and the fluid trapped between the plate body 121 and the panel 11 due to the adsorption can be reduced by widening the gap. However, since no diversion is provided to a path of the fluid flow, a flow direction of the fluid between the pressing member 12 and the panel 11 is uncontrollable, and other problems are therefore likely to arise to affect stability of the device. The flow diverting portion 123 in the present disclosure may also be in other forms. For example, in the following description, the present disclosure provides a flow diverting portion 123 with a structure which can achieve directed diversion of the fluid.

In conjunction with FIG. 1 to FIG. 7, in some embodiments of the present disclosure, the flow diverting portion 123 is disposed on a surface of the plate body 121 facing towards the panel 11. A groove is defined on the surface of the plate body 121 as the flow diverting portion 123. In some embodiments, the flow diverting portion 123 is disposed on the surface of the plate body 121 facing towards the panel 11. The flow diverting portion 123 includes a first flow diverting groove 1231 and a second flow diverting groove 1232. The first flow diverting groove 1231 is defined around the button 122. The second flow diverting groove 1232 is in communication with the first flow diverting groove 1231 and extends to an edge of the plate body 121 through the plate body 121.

Since the fluid enters between the panel 11 and the display box 13 through the gap between the button 122 and the inner peripheral surface of the fitting hole 101, special protection should be provided around the button 122 to facilitate prompt collection and diversion of the fluid entering between the panel 11 and the display box 13. In some embodiments, in the present disclosure, the first flow diverting groove 1231 is disposed around the button 122. The fluid entering the interior of the panel 11 through the fitting hole 101 may be collected in the first flow diverting groove 1231. The fluid in the first flow diverting groove 1231 may subsequently be diverted towards a predetermined position through diversion of the second flow diverting groove 1232 to achieve directional diversion of the fluid entering the interior of the panel 11 and improve performance on fluid diversion. As a result, the safety and stability of the panel assembly 100 can be improved.

In some embodiments, as illustrated in FIG. 6, the surface of the plate body 121 is partially hollowed out to form the first flow diverting groove 1231 and the second flow diverting groove 1232. Both the first flow diverting groove 1231 and the second flow diverting groove 1232 are defined on the surface of the plate body 121 facing towards the panel 11. Therefore, hollowing out the surface of the plate body 121 can not only make it easy to form the flow diverting grooves on the plate body 121, but also save a material for forming the pressing member 12, which is energy-saving and environmentally friendly. In addition, collection and diversion of the fluid entering between the panel 11 and the display box 13 can be facilitated to shorten time in which the fluid is kept between the panel 11 and the display box 13, allowing a risk of damages to the display box 13 to be greatly lowered.

In addition, a part around the button 122 is hollowed out to form the first flow diverting groove 1231, and at the same time, a part of the plate body 121 connected to the button 122 is thinned. In this way, it is possible for the button 122 to deform readily and easily, which can effectively facilitate use of the button 122.

That is, a first groove portion and a second groove portion are formed on the surface of the plate body 121. The second groove portion is in communication with the first groove portion. The button 122 is disposed on a bottom wall of the first groove portion. Since the first groove portion, which can be easily deformed due to its thinner bottom wall, is disposed on the plate body 121, when the button 122 is disposed on the bottom wall of the first groove portion, it is possible to promptly enable the bottom wall of the first groove portion to be deformed when the button 122 is pressed by an external force, allowing the button 122 to be pressed easily. Moreover, the bottom wall of the first groove portion may also provide a reset force to the button 122 to improve stability and tactility of the button 122.

The first flow diverting groove 1231 described above is formed between an inner peripheral surface of the first groove portion and an outer peripheral surface of the button 122, while the second flow diverting groove is formed as the second flow diverting groove 1232 described above.

Further, the plate body 121 is attached to an inner surface of the panel 11. Since both the first flow diverting groove 1231 and the second flow diverting groove 1232 are formed on the plate body 121, a channel for diversion may be formed between the plate body 121 and the panel 11. Considering that the plate body 121 is attached to the inner surface of the panel 11, sealing can be formed between opening edges of the first flow diverting groove 1231 and the second flow diverting groove 1232 and the panel 11 to from a sealing structure between the surface of the plate body 121 and the inner surface of the panel 11. With the sealing structure formed between the plate body 121 and the panel 11, the gap between the plate body 121 and the panel 11 can be sealed. In this way, a gap that may exist around the first flow diverting groove 1231 is also sealed. Therefore, the fluid entering the first flow diverting groove 1231 can be easily diverted through the second flow diverting groove 1232 to prevent the fluid entering the first flow diverting groove 1231 from re-entering a space between the panel 11 and the plate body 121, which effectively improves the performance on the fluid diversion.

In at least one embodiment, a number of the button 122 may be changed in accordance with different devices in which the panel assembly 100 is applied and diversified functions of the different devices to facilitate better control of the devices. In some embodiments, one or more fitting holes 101 are defined on the panel 11. One or more buttons 122 are provided in one-to-one correspondence with the one or more fitting holes 101. The flow diverting portion 123 is provided for each of the one or more buttons 122 and disposed around each of the one or more buttons 122. Therefore, requirements of different products and users on operation methods can be satisfied to make it easy to control the device provided with the panel assembly 100, which improves stability and convenience of the panel assembly 100.

In addition, the expression "the flow diverting portion 123 is provided for each of the one or more buttons 122 and disposed around each of the one or more buttons 122" may mean that the flow diverting portion 123 is separately disposed around each of the one or more buttons 122. That is, the flow diverting portions 123 and the buttons 122 are in one-to-one correspondence. The flow diverting portion 123 may be in other forms. For example, a common flow diverting portion 123 may be provided. That is, one flow diverting portion 123 may be provided around a plurality of buttons 122. In this way, the fluid at the plurality of buttons 122 can be collected and subsequently diverted and discharged totally.

In at least one embodiment, the pressing member 12 may be a flexible integrated plate. With such flexible pressing member 12, sealing performance between the plate body 121 and the panel 11 can be effectively improved to further facilitate diversion of the flow diverting portion 123. In addition, the flexible plate body 121 can facilitate pressing of the button 122. In addition, during the pressing, the flexible plate body 121 can provide a suitable feedback force and reset force to facilitate reset of the button 122 and improve pressing experience of the button 122.

In addition, the pressing member 12 may be a separated member. For example, the plate body 121 is a flexible plate, and the button 122 is separated from a body of the pressing member 12, and is flexible, or the button 122 may be a bump. The button 122 and the plate body 121 may be molded separately and subsequently assembled together; or the plate body 121 and the button 122 may be integrally formed through injection molding after the button 122 is molded.

In conjunction with FIG. 1 to FIG. 7, in some embodiments of the present disclosure, the display box 13 has an accommodation groove 103. The accommodation groove 103 is defined on a surface of the display box 13 facing towards the panel 11, and the pressing member 12 is embedded in the accommodation groove 103. With the arrangement of the accommodation groove 103, stability of engagement between the pressing member 12 and the display box 13 can be improved to facilitate mounting of the pressing member 12 in a corresponding position on the display box 13, allowing easy mounting to be realized.

In some embodiments, an important function of the pressing member 12 in use is to select a corresponding control mode through the button 122, for such a reason that the display box 13 needs to be engaged with the pressing member 12 precisely. Therefore, with the arrangement of the accommodation groove 103, precision of the engagement between the pressing member 12 and the display box 13 can be effectively improved to facilitate a prompt and convenient selection of the corresponding function.

Figure 7:
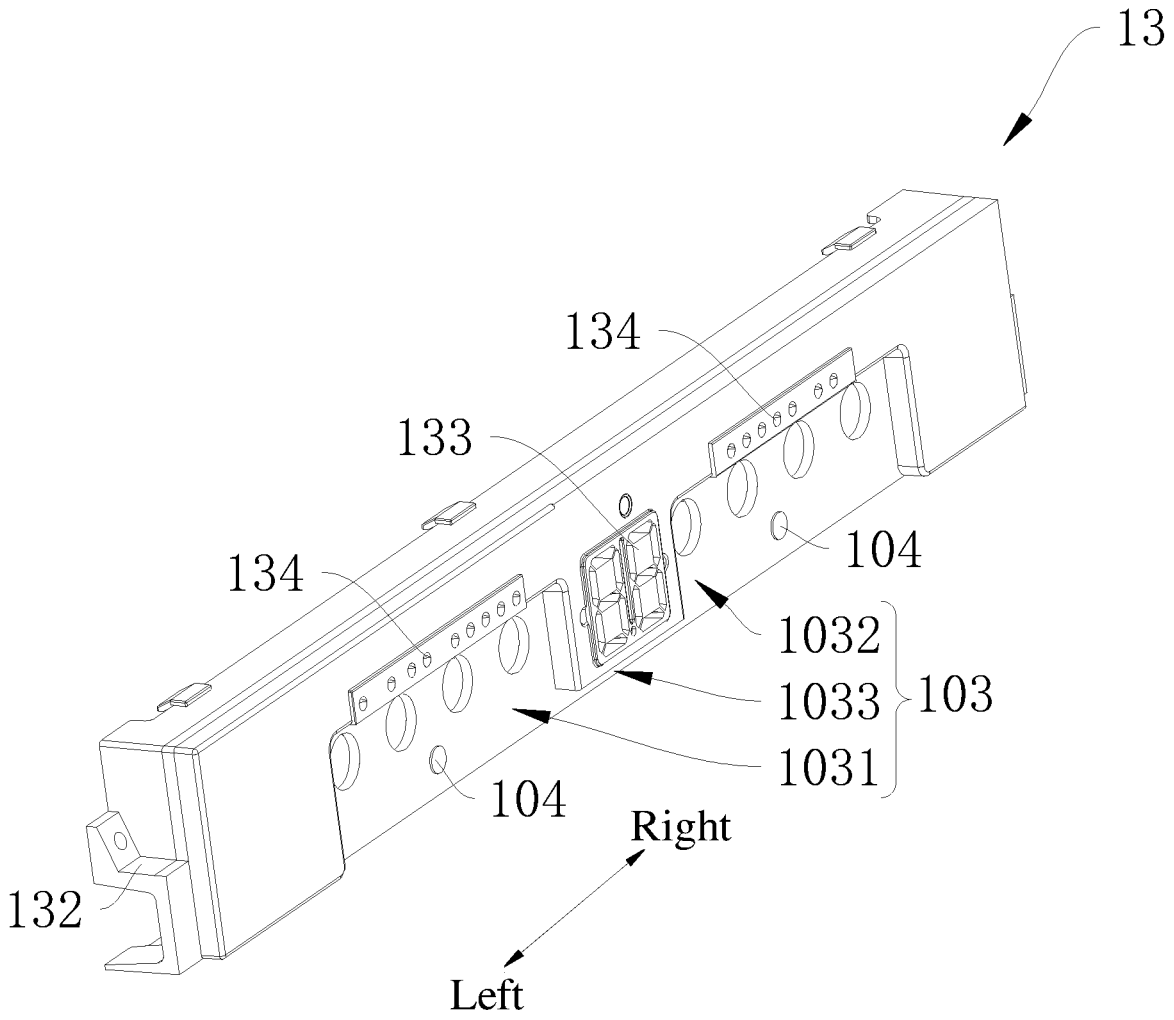
FIG. 7 is a schematic view of a display box of a panel assembly according to an embodiment of the present disclosure.

In some embodiments, as illustrated in FIG. 3, FIGS. 6, and 7, one of the plate body 121 and the display box 13 is provided with a positioning post 104, and the other one of the plate body 121 and the display box 13 is provided with a positioning hole 102. The positioning post 104 is embedded in the positioning hole 102. In this way, the precision of the engagement between the pressing member 12 and the display box 13 can be further improved. In addition, the engagement between the positioning post 104 and the positioning hole 102 can not only realize pre-positioning of the plate body 121 and the display box 13, but also avoid a displacement of the pressing member 12 relative to the display box 13. As a result, the stability of the panel assembly 100 can be effectively improved.

For example, as illustrated in FIG. 6 and FIG. 7, in combination with certain embodiments described above, the accommodation groove 103 is defined on the display box 13.

The positioning post 104 is disposed on an inner bottom surface of the accommodation groove 103. The positioning hole 102 is defined on the plate body 121. During mounting, the pressing member 12 is mounted in the accommodation groove 103 and the positioning post 104 is embedded in the positioning hole 102 to realize the pre-positioning of the pressing member 12. Further, stability of the engagement between the plate body 121 and the display box 13 can be effectively improved.

In at least one embodiment, the display box 13 has a display region, and the panel 11 is thinned to form a thinned region at a position directly opposite to the display region. That is, content of the display region of the display box 13 is displayed through the thinned region. By hiding the display box 13 in the interior of the panel 11, a number of through holes defined in the panel 11 can be reduced to lower a possibility of fluid and other impurities from outside entering the interior of the panel 11 to effectively protect the display box 13, and the panel assembly 100 also has an aesthetically pleasing appearance. In addition, in the event of damages to the display region from the outside the panel 11, it is possible to only replace the panel 11 instead of replacing the entire panel assembly 100.

In addition, by providing the thinned region, it can be facilitated that light emitted from the display box 13 can pass through the panel 11 more easily, allowing the content to be displayed to be easily formed on the panel 11. Correspondingly, the display region of the display box 13 may protrude relative to other positions on the display box 13, which can facilitate a close arrangement of the display region relative to the thinned region to improve display effect. In some embodiments, a groove structure may be formed on an inner side surface of the panel 11 to form the thinned region. In this way, the display region protruding from the display box 13 can extend into this groove to reduce the spacing between the display region and a surface of the panel 11, which can improve the display effect.

In some embodiments, the panel 11 is provided with a limiting rib. The limiting rib abuts against a side edge of the display box. By providing the limiting rib, the display box 13 can be stably mounted on the panel 11 to improve strength of engagement between the display box 13 and the panel 11.

Figure 4:
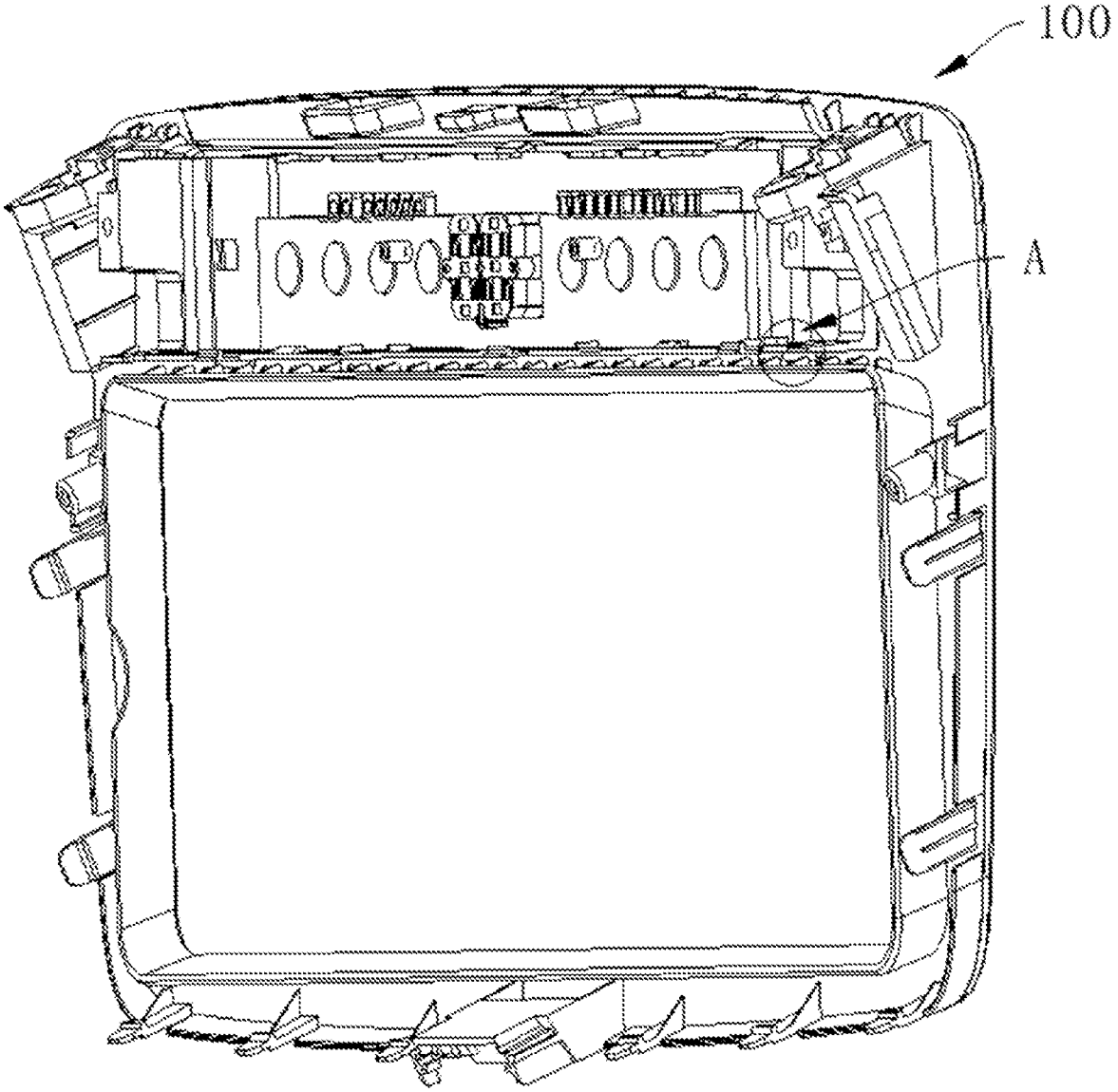
FIG. 4 is a schematic diagram of a panel assembly according to an embodiment of the present disclosure.
Figure 5:
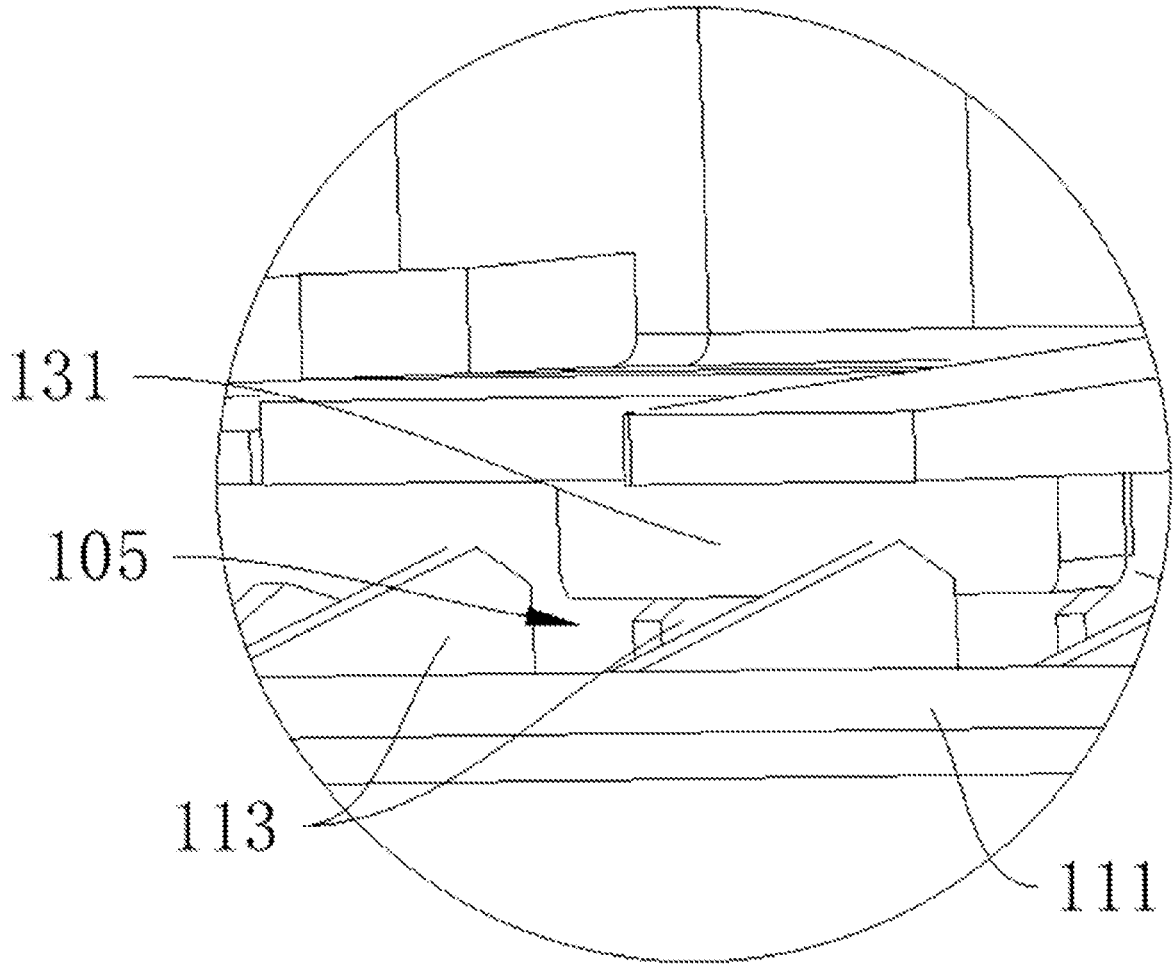
FIG. 5 is a schematic enlarged partial view of a circled region A in FIG. 4.

In some embodiments, as illustrated in FIG. 1, FIG. 4, and FIG. 5, the limiting rib includes a first rib 111 and a second rib 112. Both the first rib 111 and the second rib 112 are disposed on the panel 11. The display box 13 is disposed between the first rib 111 and the second rib 112. Two sides of the display box 13 in a width direction thereof abut against the first rib 111 and the second rib 112, respectively. A gap is formed between the display box 13 and at least one of the first rib 111 and the second rib 112. The flow diverting portion 123 is configured to divert the fluid towards the at least one of the first rib 111 and the second rib 112.

In some embodiments, the first rib 111 and the second rib 112 are located at different positions on the panel 11. In the present disclosure, the panel 11 may be inclined downwardly. In terms of a horizontal plane, the first rib 111 may be arranged at a lower level than the second rib 112. Therefore, the flow diverting portion 123 described above may be configured to divert the fluid towards the first rib 111. For example, the second flow diverting groove 1232 described above may be configured to pass through a lower edge of the plate body 121. That is, one end of the second flow diverting groove 1232 adjacent to the first rib 111 passes through the plate body 121. In this case, a gap may be formed between the display box and the first rib 111, in which case the fluid can be discharged through the gap between the display box and the first rib 111 after diverted by the flow diverting portion 123.

The gap may be formed by providing a supporting rib 113 on the first rib 111. For example, the first rib 111 has a plurality of supporting ribs 113 arranged at intervals in a length direction thereof (a left-right direction in the drawings), and one side of the display box 13 abuts against the supporting rib 113, which facilitates a formation of a gap between the display box 13 and a lower supporting rib 113 of the plurality of supporting ribs 113.

In addition, the display box 13 may also be provided with a positioning rib 131 on a side thereof. The positioning rib 131 is inserted into and positioned at the first rib 111. A notch 105 may be formed on a side of the supporting rib 113 facing towards the second rib 112 to catch the positioning rib 131 in the notch 105. In some embodiments, the display box 13 has one end snap-fitted with the notch 105 and another end pressed and embedded into the second rib 112 on an inner side of the second rib 112. Therefore, in order to facilitate embedding of the other end of the display box 13 into the second rib 112 on the inner side of the second rib 112, the second rib 112 may be configured as an arc form that is gradually inclined away from the first rib 111 in a direction facing away from the back surface of the panel 11, which can facilitate mounting of the display box 13 and avoid a problem of an insufficient space during the mounting.

A plurality of reinforcing rib structures may further be connected between the second rib 112 and the inner side surface of the panel 11.

In at least one embodiment, both ends of the display box 13 in a length direction thereof (the left-right direction in the drawings) are fixedly connected to the panel 11. The pressing member 12 is fixedly clamped through engagement of display box 13 with the panel 11. Therefore, the display box 13 can be stably mounted on the panel 11. In addition, stable mounting of the pressing member 12 can be realized through the engagement between the display box 13 and the panel 11. Clamping the pressing member 12 can provide the pressing member 12 with a predetermined pressure to effectively improve sealing performance between the pressing member 12 and the panel 11.

For example, a connection sheet 132 is disposed at either end of the display box 13 in the length direction thereof. The connection sheet 132 may have a first connection hole. The panel 11 may have a second connection hole. The first connection hole and the second connection hole may be assembled together by a fastener.

In some embodiments, in conjunction with the above embodiments, during the mounting of the display box 13, the pressing member 12 is pre-positioned into the accommodation groove 103 as described, subsequently the positioning rib 131 on one end of the display box 13 is inserted into and positioned at the notch 105 of the supporting rib 113, and the other end of the display box 13 is rotated to the inner side of the second rib 112. In this case, the connection sheets 132 on both ends of the display box 13 in the length direction may correspond to features on the panel 11, and the first connection hole is opposite to the second connection hole. At this time, the display box 13 is locked to the panel 11 by a fastener such as a screw to complete the mounting of the display box 13.

Such a mounting manner can facilitate convenient and prompt mounting of the display box 13 on the panel 11.

In some embodiments of the present disclosure, as illustrated in FIG. 6, the plate body 121 includes a first plate portion 1211, a second plate portion 1212, and a connection portion 1213. The first plate portion 1211, the connection portion 1213, and the second plate portion 1212 are connected sequentially in a length direction (the left-right direction in the drawings) of the plate body 121. The display box 13 has a first recess 1031, a second recess 1032, and a communication groove portion 1033. That is, in combination with the above embodiments, the accommodation groove 103 includes the first recess 1031, the second recess 1032, and the communication groove portion 1033. The first recess 1031, the communication groove portion, and the second recess 1032 are communicated sequentially in the length direction of the display box 13. The first plate portion 1211 is embedded in the first recess 1031. The second plate portion 1212 is embedded in the second recess 1032. The connection portion 1213 is embedded in the communication groove portion 1033. Therefore, through engagement between the plate body 121 and the accommodation groove 103, stable mounting of the pressing member 12 can be realized to improve the stability of the engagement between the pressing member 12 and the display box 13.

In some embodiments, in a width direction (a front-rear direction in the drawings) of the plate body 121, the connection portion 1213 may be connected to edges of the plate body 121 in the width direction, and the communication groove portion 1033 is also connected to edges of the display box 13 in a width direction (the front-rear direction in the drawings). The plate body 121 is configured as a generally U-shaped structure. The first recess 1031, the second recess 1032, and the communication groove portion are also formed into a generally U-shaped structure. The plate body 121 is embedded in the display box 13. In this way, a position of the plate body 121 is uniquely determined, which facilitates mounting of the pressing member 12.

In some embodiments, the button 122 is disposed on each of the first plate portion 1211 and the second plate portion 1212. The display region includes a digital display region 133 and a lighting region 134. The lighting region 134 and the button 122 are opposite to each other in the width direction of the plate body 121 (the front-rear direction in the drawings). The digital display region 133 is located between the first recess 1031 and the second recess 1032 in the length direction of the plate body 121. A pressing behavior of the button 122 may be displayed by the lighting region 134. Pressing of the button 122 can be displayed by the lighting region 134 and the digital display region 133, which makes it easy for a user to intuitively understand a response to the pressing and facilitates control.

An air conditioner according to an embodiment of the present disclosure includes a body and the panel assembly 100 as described above. The panel assembly 100 is disposed on the body. The air conditioner of the present disclosure may be a hanging air conditioner, a cabinet air conditioner, a mobile air conditioner, a window air conditioner, or the like.

According to the air conditioner of the embodiment of the present disclosure, since the panel assembly 100 as described above is provided, the flow diverting portion 123 disposed around the button 122 can achieve diversion of a fluid, especially a fluid entering between the pressing member 12 and the panel 11. Since the flow diverting portion 123 is capable of diverting the fluid out of the display box 13, the fluid can be prevented from entering the display box 13 to avoid damages to the electronic components inside the display box 13, which effectively improves the stability and safety of operation of the display box 13, and prolongs the lifespan of the display box 13.

In addition, the panel assembly 100 of the present disclosure is especially suitable for a mobile air conditioner.

In some embodiments, a body of the mobile air conditioner has an air duct structure opened at a top thereof. The panel 11 is disposed at the top of the body. The panel 11 has an air outlet directly facing towards the air duct structure. An airflow may be blown out through the air outlet. The panel 11 is inclined downwardly in a direction from rear to front. The fitting hole 101, the button 122, and the like are disposed at a front side or a rear side of the air outlet. The flow diverting portion 123 as described above is inclined downwardly to divert a fluid. That is, the second flow diverting groove 1232 extends to a lower edge of the plate body 121 through the plate body 121.

In addition, a flange is disposed around the air outlet defined on the panel 11 of the present disclosure. The flange may extend towards the back surface of the panel 11. A plurality of snap hooks is arranged at intervals along the flange. The plurality of snap hooks can effectively improve stability of engagement between the panel assembly 100 and the body.

The panel assembly 100 of the present disclosure includes the panel 11, the display box 13, and the pressing member 12 (e.g., a button of a silicone structure). The panel 11 is thinned at a corresponding display position to form a hidden display arrangement. The display box 13 is controlled by the pressing member 12. A display light on the display box 13 is displayed through the panel 11. An icon is silkscreen printed at a position on an outer surface of the panel 11 corresponding to a light hole. For the hidden display arrangement without label, mechanical buttons provide poor sealing performance. In humid weather, or in a special circumstance, e.g., the whole machine is caught in the rain, a display panel gets wet easily. A silicone button scheme can provide better sealing and waterproof performance. In addition, a groove is defined on the pressing member 12 to divert the fluid. The flow diverting portion 123 can divert the fluid away when the fluid flows through a gap between the pressing member 12 and the panel 11 to avoid damages to the display panel caused by an ingress of fluid into the interior of the display box 13.

Figure 8:
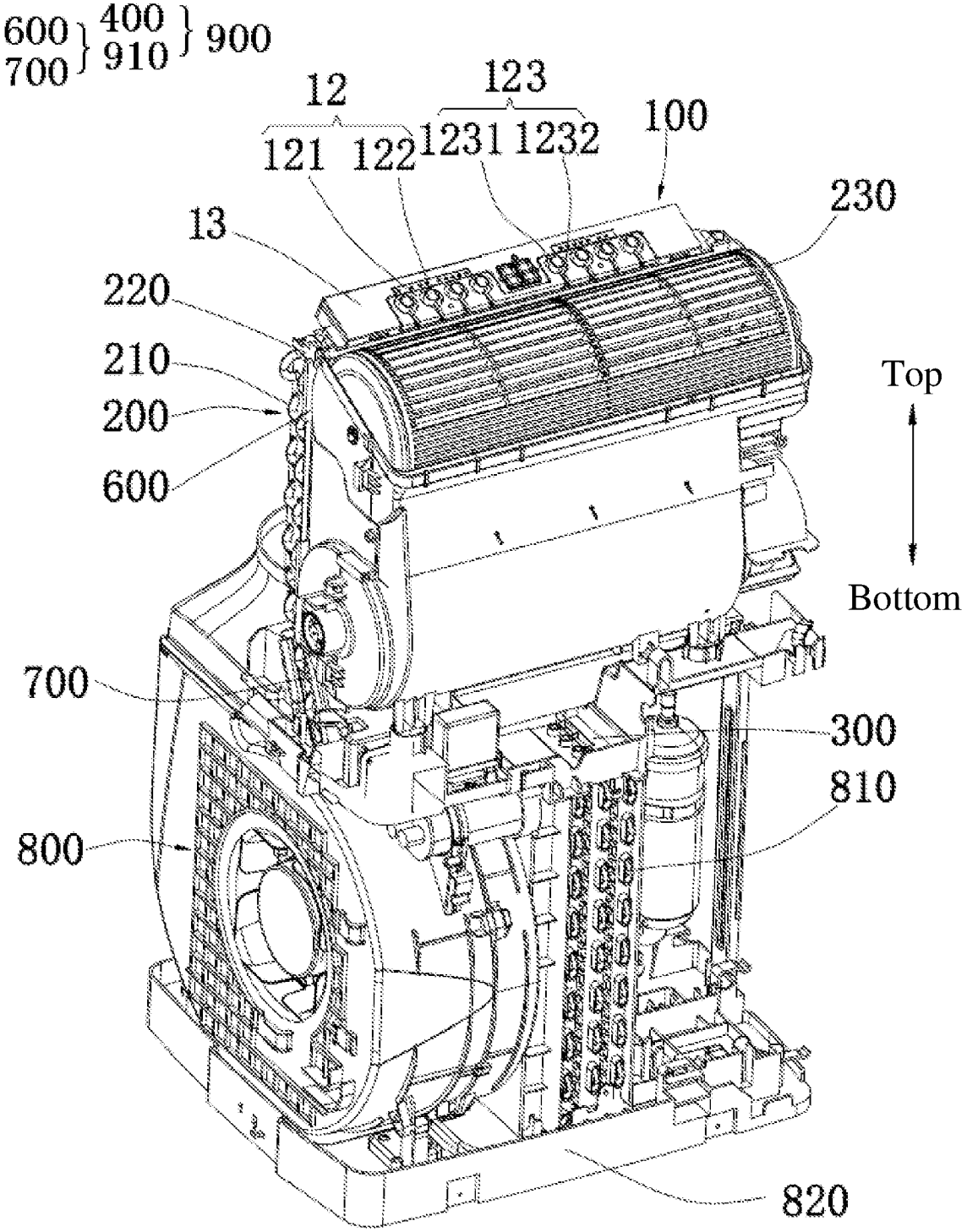
FIG. 8 is a schematic perspective view of an air conditioner with a housing removed according to an embodiment of the present disclosure.
Figure 9:
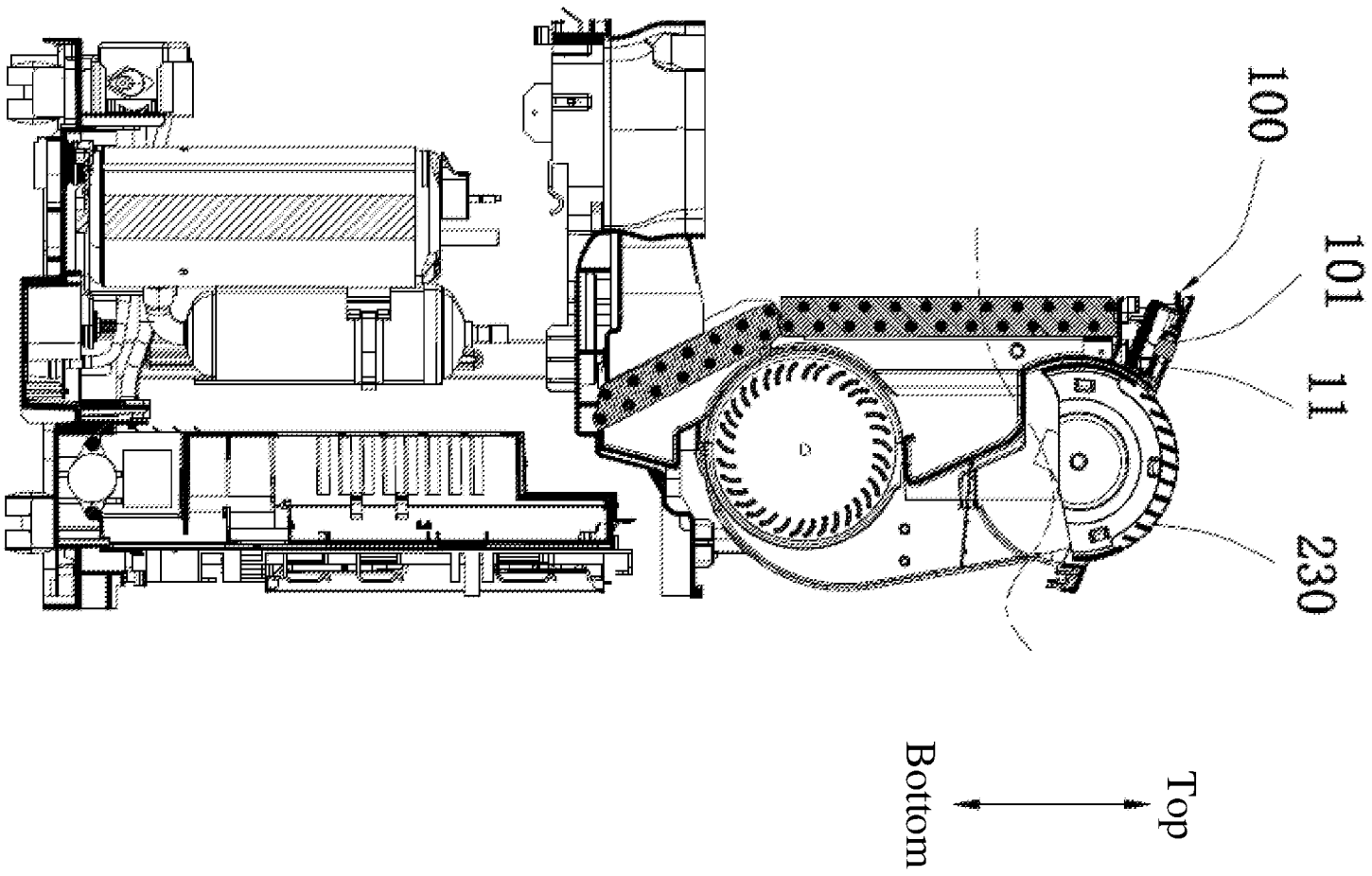
FIG. 9 is a cross-sectional view of the air conditioner illustrated in FIG. 8.
Figure 10:
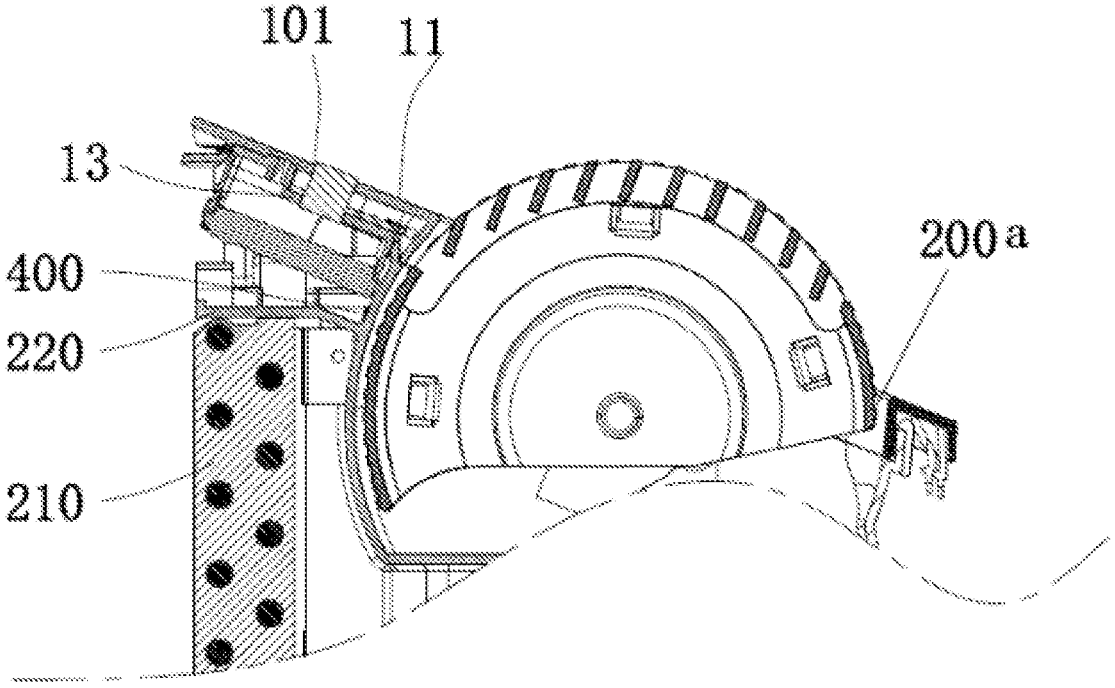
FIG. 10 is a schematic partial view of the air conditioner according to an embodiment illustrated in FIG. 9.

In some embodiments, as illustrated in FIG. 8 to FIG. 10, the air conditioner is a mobile air conditioner. The panel assembly 100 is disposed at an upper part of the body. The flow diverting portion 123 is configured to divert the fluid out of the display box 13 to drain the fluid inside the panel assembly 100. The air conditioner further includes a flow guide structure 900. The flow guide structure 900 is disposed inside the body, and configured to guide the fluid diverted by the flow diverting portion 123 into a predetermined position. It is conceivable that the predetermined position may be a base 820 disposed at a bottom of the mobile air conditioner, or other components in the mobile air conditioner that are capable of receiving the fluid, e.g., an intermediate partition plate 300 disposed in a middle of the body, or a certain component outside the body that receives the fluid, and the present disclosure is not limited thereto.

The flow diverting portion 123 is disposed on the plate body 121, and thus is located inside the panel assembly 100. As a result, the flow diverting portion 123 can divert the fluid entering the panel assembly 100. Since the flow diverting portion 123 can divert the fluid out of the display box 13, damages to the electronic components inside the display box 13 due to an entrance of the fluid into the display box 13 can be avoided to effectively improve stability and safety of operation of the electronic components in the display box 13, and prolong lifespans of the electronic components in the display box 13. For example, the ingress of the fluid into the panel assembly 100 due to accidental splashing can be avoided. Moreover, the fluid diverted by the flow diverting portion 123 can be guided into the predetermined position by the flow guide structure 900, it is thus possible to prevent the fluid diverted by the flow diverting portion 123 from spilling in a use environment and affecting environmental sanitation. For example, the wet and slippery ground resulted from the fluid spilled on the ground can be avoided, which may cause people to fall and get injured.

Figure 11:
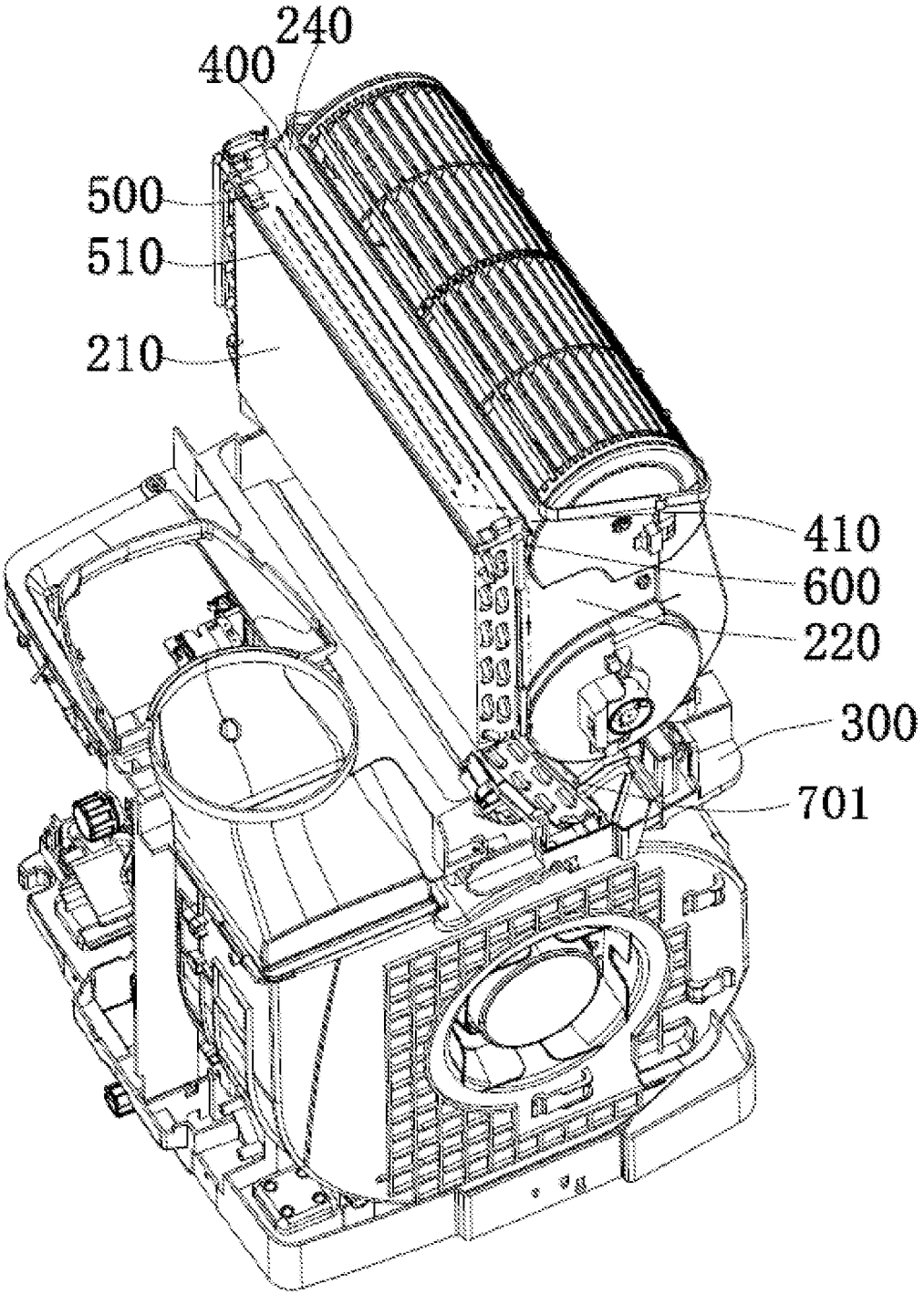
FIG. 11 is a schematic perspective view of an air conditioner with a panel assembly removed according to an embodiment of the present disclosure.
Figure 12:
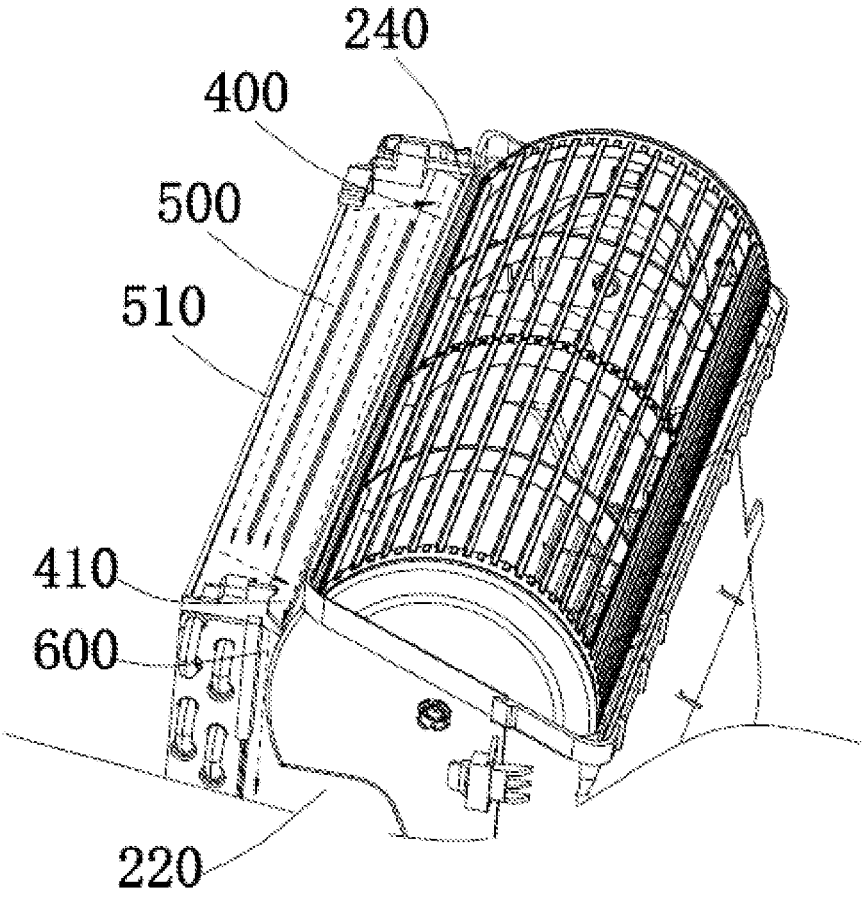
FIG. 12 is a schematic partial view of the air conditioner according to an embodiment illustrated in FIG. 11.
Figure 13:
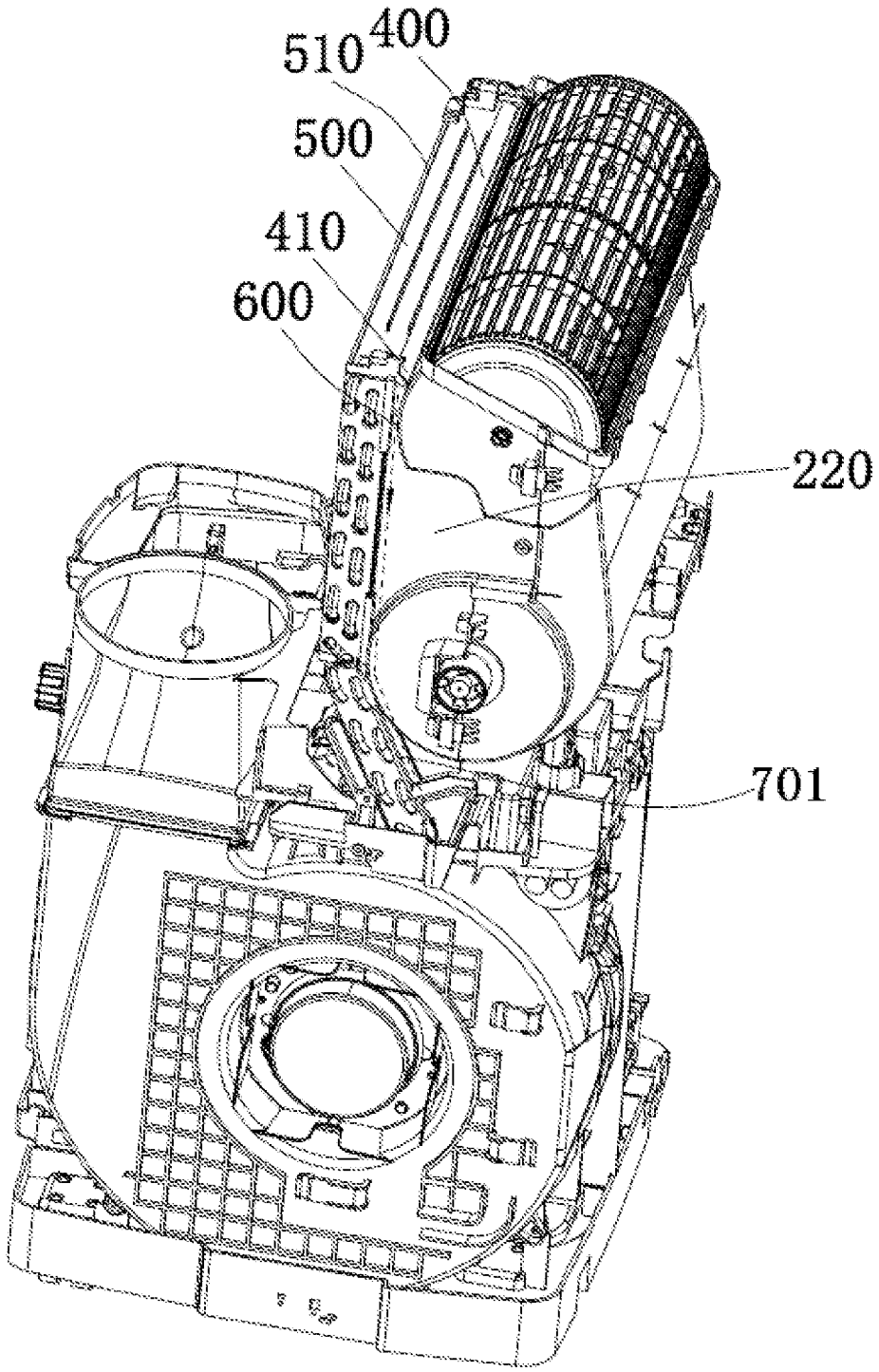
FIG. 13 is a schematic structural view of the air conditioner according to an embodiment illustrated in FIG. 11 from another view direction.

With reference to FIG. 11 to FIG. 13, in some embodiments of the present disclosure, the body is provided with an upper air duct assembly 200. The upper air duct assembly 200 includes an upper air duct heat exchanger 210, a scroll housing 220, and an upper air duct fan 230 disposed in the scroll housing 220. The upper air duct fan 230 may be a centrifugal fan or a cross-flow fan. The flow guide structure 900 is disposed on the scroll housing 220. In this way, since the flow guide structure 900 is disposed on the scroll housing 220 of the upper air duct assembly 200, it is possible to reduce a number of parts in the mobile air conditioner and lower production costs of the mobile air conditioner. Meanwhile, in a cooling mode of the air conditioner, the upper air duct heat exchanger 210 is an evaporator. The evaporator can absorb heat during operation, and has a lower temperature. When indoor air with a high temperature exchanges heat with the evaporator, condensed fluid may be generated. Therefore, the condensed fluid may be generated on a surface of the scroll housing 220 above the upper air duct heat exchanger 210 and an outer wall surface 240 of an air outlet 200*a*. With the flow guide structure 900, the condensed fluid may be guided into the predetermined position simultaneously to avoid damages to the mobile air conditioner caused by the condensed fluid entering the electronic components of the mobile air conditioner.

For example, the flow guide structure 900 and the scroll housing 220 are integrally formed, which can save assembly steps of the flow guide structure 900 and the scroll housing 220 and reduce assembly time spent on the mobile air conditioner.

With reference to FIG. 11 and FIG. 12, in some embodiments of the present disclosure, the flow guide structure 900 includes a fluid receiving tank 400 and a fluid diverting structure 910. The fluid receiving tank 400 is defined between the scroll housing 220 and the outer wall surface 240 of the air outlet 200*a* of the upper air duct assembly 200. The fluid receiving tank 400 extends in a length direction of the air outlet 200*a*. The fluid receiving tank 400 is adapted to collect the fluid diverted by the flow diverting portion 123. The fluid receiving tank 400 is provided with a drainage portion 410 on at least one end thereof. For example, the drainage portion 410 is disposed on one end of the fluid receiving tank 400, or the drainage portion 410 is disposed on each of ends of the fluid receiving tank 400. The fluid diverting structure 910 is disposed on a side wall of the scroll housing 220. The fluid diverting structure 910 has an upper part configured to joint with a corresponding drainage portion 410 and a lower part configured to divert the fluid into the predetermined position. The fluid diverting structure 910 serves to divert the fluid in the fluid receiving tank 400 into the predetermined position.

With reference to FIG. 11 to FIG. 13, in some embodiments, the drainage portion 410 is formed as a drainage notch as illustrated in the drawings. The fluid in the fluid receiving tank 400 may be discharged into the fluid diverting structure 910 through the drainage portion 410. It can be understood that in some embodiments, the drainage portion 410 may be formed as a drainage hole, and the present disclosure is not limited in this regard.

With reference to FIGS. 11 and 12, in some embodiments of the present disclosure, the scroll housing 220 is provided with a sealing plate 500. The sealing plate 500 may be disposed above the upper air duct heat exchanger 210 between the upper air duct heat exchanger 210 and the scroll housing 220. The fluid receiving tank 400 is disposed between the sealing plate 500 and the outer wall surface 240 of the air outlet 200*a* of the upper air duct assembly 200. The sealing plate 500 is provided with a fluid retaining rib 510. The fluid retaining rib 510 is disposed on an edge of the sealing plate 500. The fluid retaining rib extends upwards along a surface of the sealing plate 500, and protrudes from the surface of the sealing plate 500, in such a manner that the condensed fluid can be prevented from overflowing other parts of the sealing plate 500, and can flow to the fluid receiving tank 400.

With reference to FIG. 10 and FIG. 12, in this embodiment, the upper air duct fan 230 is a centrifugal fan, and the fluid receiving tank 400 is disposed in an axial direction of the upper air duct fan 230. Moreover, in this embodiment, a surface of the sealing plate 500 facing away from the upper air duct fan 230 is located at a higher level than a surface of the sealing plate 500 close to the upper air duct fan 230. That is, the surface of the sealing plate 500 is inclined towards the upper air duct fan 230, allowing the fluid receiving tank 400 to be defined between the surface of the sealing plate 500 and the outer wall surface 240 of the air outlet 200*a* of the upper air duct assembly 200. Therefore, no additional fluid receiving tank 400 is required, which can reduce assembling steps of the mobile air conditioner and improve assembly efficiency. In addition, it is possible to reduce costs. Further, the condensed fluid that may be generated on the surface of the sealing plate 500 above the upper air duct heat exchanger 210 and on the outer wall surface 240 of the air outlet 200*a* can automatically flow into the fluid receiving tank 400.

For example, in examples of FIG. 11 to FIG. 13, FIG. 15, and FIG. 16, the sealing plate 500 has one or more flow guide ribs disposed on an upper surface thereof. The one or more flow guide ribs may extend in a length direction of the drainage portion 410. In this way, the one or more flow guide ribs can guide the condensed fluid generated on the upper surface of the sealing plate 500, and allow the condensed fluid at different positions to flow to the drainage portion 410 in order. In addition, the one or more flow guide ribs can enhance structural strength of the sealing plate 500.

It should be noted that when a plurality of flow guide ribs is provided, the plurality of flow guide ribs may be arranged at intervals in a width direction of the drainage portion 410 to allow a flow guide channel to be defined between two adjacent flow guide ribs of the plurality of flow guide ribs. The condensed fluid generated on the upper surface of the sealing plate 500 can flow to the drainage portion 410 along the flow guide channels.

It is conceivable that in some embodiments, the drainage portions 410 may be disposed at both ends of the fluid receiving tank 400. Correspondingly, the fluid diverting structures 910 configured to joint with the corresponding drainage portions 410 are disposed on two side walls of the scroll housing 220, allowing the fluid flowing out of the corresponding drainage portions 410 to be diverted into the predetermined position by the fluid diverting structures 910. When the drainage portions 410 are disposed at both ends of the fluid receiving tank 400, it should be considered that the condensed fluid is avoided from dripping on the electrical device to avoid failures thereof. The drainage portion 410 may also be disposed on one end of the fluid receiving tank 400, in which case one side wall of the scroll housing 220 has the fluid diverting structure 910. The fluid diverting structure 910 corresponds to the drainage portion 410.

With reference to FIG. 11 and FIG. 13, in some embodiments of the present disclosure, the upper part of the fluid diverting structure 910 is configured as a fluid diverting groove 600, and the lower part of the fluid diverting structure 910 is configured as a flow diverting rib 700. The flow diverting rib 700 is inclined relative to a horizontal plane at a predetermined angle, in which case the flow diverting rib 700 may be inclined relative to both the horizontal plane and a vertical plane; or the flow diverting rib 700 is arranged vertically, in which case the fluid may flow in an extending direction of the flow diverting rib 700. Through diversion of the fluid diverting groove 600 and the flow diverting rib 700, flooding of the fluid can be avoided to prevent the fluid from flowing onto other parts, which can ensure normal use of the device.

It should be noted that in some embodiments of the present disclosure, the fluid diverting structure 910 may be configured entirely as the fluid diverting groove 600. In some embodiments, the fluid diverting structure 910 is configured entirely as the flow diverting rib 700. In addition, in some embodiments, the fluid diverting structure 910 may also be configured as a structure including both the fluid diverting groove 600 and the flow diverting rib 700 on a basis of a specific structure of a part for supporting the fluid diverting structure 910. For example, the upper part of the fluid diverting structure 910 is configured as the flow diverting rib 700, and the lower part of the fluid diverting structure 910 is configured as the fluid diverting groove 600, and details thereof will be omitted herein.

With reference to FIG. 11 and FIG. 13, in some embodiments of the present disclosure, the fluid diverting structure 910 is configured to include a flow diverting rib 700. The flow diverting rib 700 includes a first flow diverting segment 701. The first flow diverting segment 701 extends obliquely towards a predetermined position relative to the horizontal plane. In this way, the fluid can flow along the first flow diverting segment 701 and guided into the predetermined position.

For example, when the entire fluid diverting structure 910 is configured as the flow diverting rib 700, an upper part of the flow diverting rib 700 is adapted to joint with the corresponding drainage portion 410, and a lower part of the flow diverting rib 700 is adapted to divert the fluid into the predetermined position. In this case, when the entire flow diverting rib 700 is formed as the first flow diverting segment 701, the first flow diverting segment 701 extends obliquely towards the predetermined position relative to the horizontal plane. Further, the upper part of the first flow diverting segment 701 is adapted to joint with the corresponding drainage portion 410, and the lower part of the first flow diverting segment 701 is adapted to divert the fluid to the predetermined position. When the entire flow diverting rib 700 includes the first flow diverting segment 701 as well as other flow diverting segments, the lower part of the flow diverting rib 700 may be formed as the first flow diverting segment 701 to divert the fluid into the predetermined position. When the fluid diverting structure 910 is configured to include the fluid diverting groove 600 and the flow diverting rib 700, the flow diverting rib 700 may include the first flow diverting segment 701. The first flow diverting segment 701 extends obliquely towards the predetermined position relative to the horizontal plane. For example, an upper end of the first flow diverting segment 701 may be directly or indirectly jointed with the fluid diverting groove 600, which allows the fluid in the fluid diverting groove 600 to flow into the first flow diverting segment 701. The other end of the first flow diverting segment 701 extends obliquely downwards relative to the horizontal plane towards the predetermined position, which allows the fluid in the first flow diverting segment 701 to flow to the predetermined position due to gravity. Alternatively, a lower end of the first flow diverting segment 701 may be directly or indirectly jointed with the fluid diverting groove 600, which allows the fluid flowing through the first flow diverting segment 701 to flow towards the fluid diverting groove 600.

In some embodiments, the predetermined position may be a fluid receiving tray 310 on the intermediate partition plate 300. It should be understood that the predetermined position is not limited to such an example. For example, the predetermined position may be a fluid collection tank inside the mobile air conditioner. When the fluid collection tank is full of the fluid, the fluid collection tank may be taken out to pour out the fluid. The predetermined position may also be a bucket, a drainage port, or the like outside the mobile air conditioner. The fluid is diverted into the predetermined position by the first flow diverting segment 701 to avoid fluid flow flooding, which prevents the fluid from flowing onto other parts and maintain the normal use of the device. For example, a short circuit caused when the fluid flows onto electronic components of the mobile air conditioner can be avoided.

Figure 15:
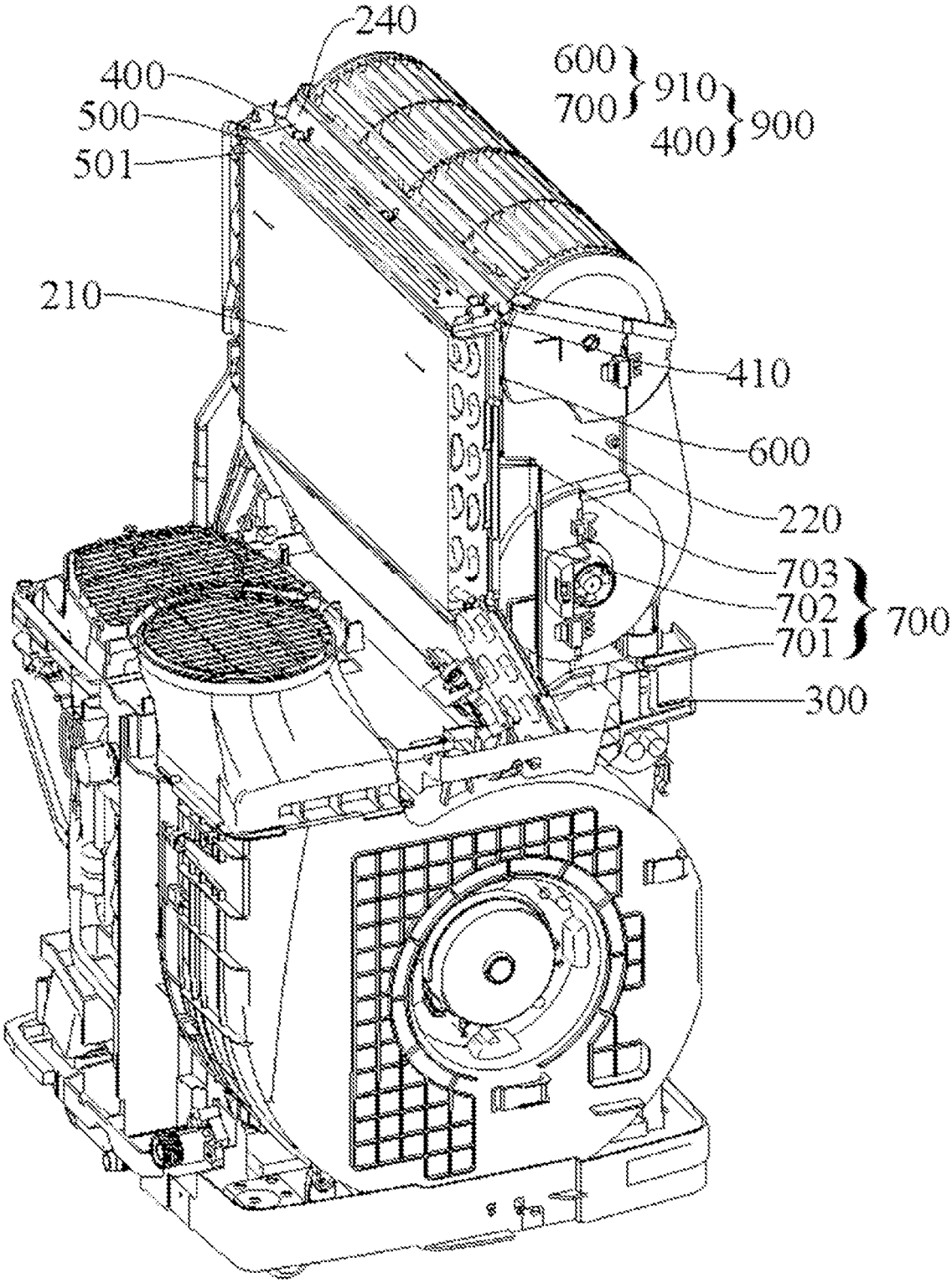
FIG. 15 is a schematic perspective view of an air conditioner with a panel assembly removed according to another embodiment of the present disclosure.
Figure 16:
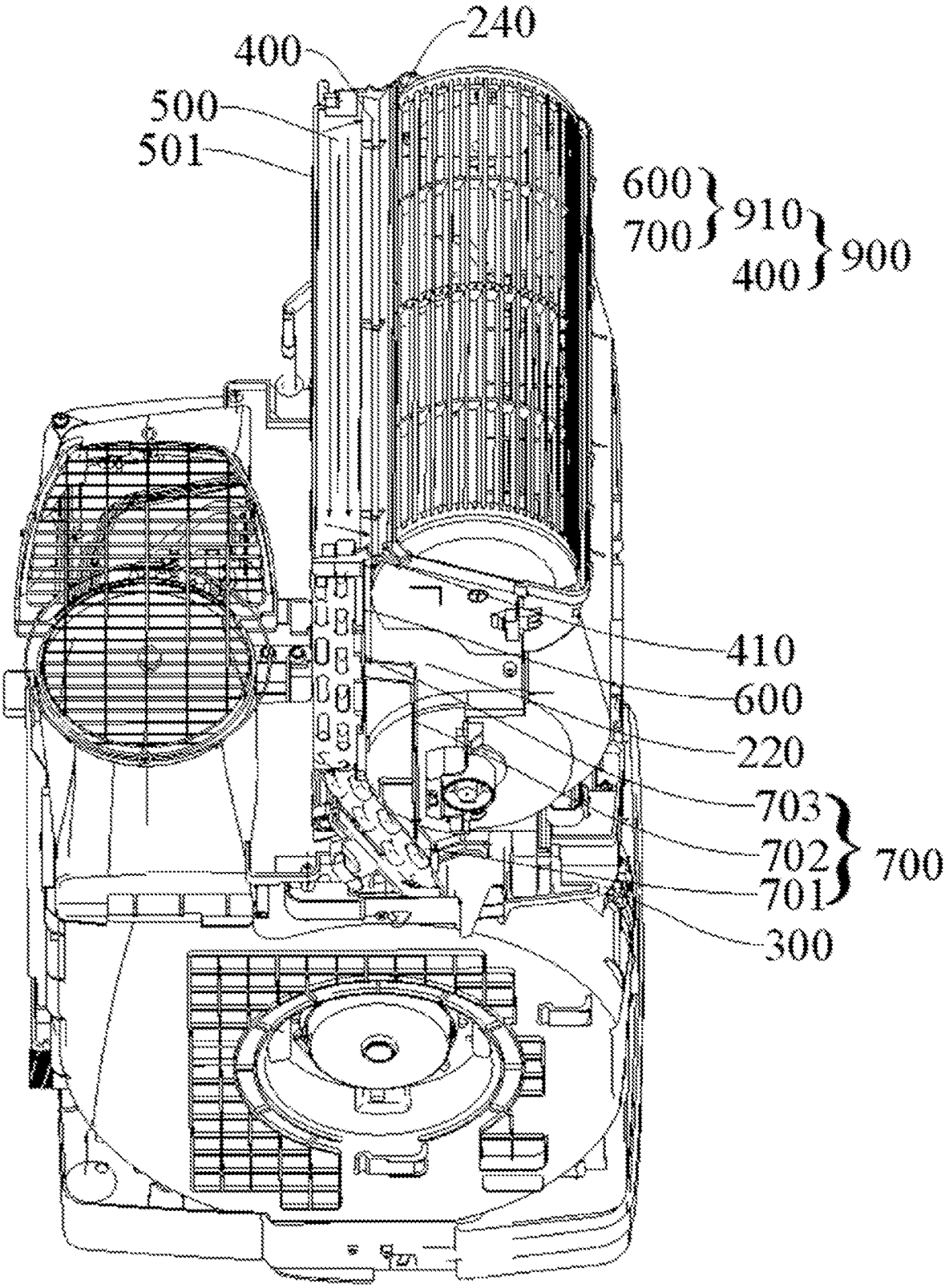
FIG. 16 is another schematic perspective view of an air conditioner with a panel assembly removed according to another embodiment of the present disclosure.

With reference to FIG. 15 and FIG. 16, in some embodiments of the present disclosure, the fluid diverting structure 910 is configured to include the flow diverting rib 700. The flow diverting rib 700 includes a second flow diverting segment 702 and a third flow diverting segment 703. The second flow diverting segment 702 extends towards the predetermined position. For example, the second flow diverting segment 702 may extend vertically towards the predetermined position, or extend obliquely towards the predetermined position relative to the horizontal plane. The third flow diverting segment 703 is disposed at an upper end of the second flow diverting segment 702. The third flow diverting segment 703 extends obliquely towards the second flow diverting segment 702 relative to the horizontal plane to divert the fluid discharged from the drainage portion to the first flow diverting segment 701. That is, the third flow diverting segment 703 extends towards the second flow diverting segment 702, and extends obliquely relative to the horizontal plane to divert the fluid to the second flow diverting segment 702. That is, the third flow diverting segment 703 extends towards the second flow diverting segment 702 from top to bottom, in such a manner that an acute angle is formed between the third flow diverting segment 703 and the horizontal plane. Therefore, the fluid can flow through the third flow diverting segment 703 and the second flow diverting segment 702 sequentially, and subsequently flow into the predetermined position.

For example, when the entire fluid diverting structure 910 is configured as the flow diverting rib 700, the upper part of the flow diverting rib 700 is adapted to joint with the corresponding drainage portion 410, and the lower part of the flow diverting rib 700 is adapted to divert the fluid into the predetermined position. In this case, the entire flow diverting rib 700 includes the second flow diverting segment 702 and the third flow diverting segment 703. The second flow diverting segment 702 extends towards the predetermined position. The upper part of the third flow diverting segment 703 is adapted to directly or indirectly joint with the corresponding drainage portion 410. The third flow diverting segment 703 is disposed at the upper end of the second flow diverting segment 702, to enable the second flow diverting segment 702 to divert the fluid into the predetermined position. When the fluid diverting structure 910 is configured to include the fluid diverting groove 600 and the flow diverting rib 700, the flow diverting rib 700 may include the first flow diverting segment 701 and the third flow diverting segment 703. The fluid diverting groove 600 may be defined at an upper end of the flow diverting rib 700 to achieve jointing between the fluid diverting structure 910 and the drainage portion 410. In this case, an upper end of the third flow diverting segment 703 is directly or indirectly jointed with the fluid diverting groove 600, to enable the fluid in the fluid diverting groove 600 to flow to the third flow diverting segment 703. A lower end of the third flow diverting segment 703 is connected to the second flow diverting segment 702. The third flow diverting segment 703 extends obliquely towards the second flow diverting segment 702 relative to the horizontal plane to allow the fluid to flow into the predetermined position under diversion of the third flow diverting segment 703 and the second flow diverting segment 702.

With reference to FIG. 15 and FIG. 16, in some embodiments of the present disclosure, the fluid diverting structure 910 is configured to include the flow diverting rib 700. The flow diverting rib 700 includes the first flow diverting segment 701, the second flow diverting segment 702, and the third flow diverting segment 703. The first flow diverting segment 701 is disposed on a lower side of the second flow diverting segment 702 to divert the fluid flowing through the second flow diverting segment 702 into the predetermined position. The fluid discharged from the drainage portion 410 can flow through the third flow diverting segment 703, the second flow diverting segment 702, and the first flow diverting segment 701 sequentially, and finally flow into the predetermined position. In addition, prolonging of a length of the flow diverting rib 700 can be facilitated, and structural strength of the scroll housing 220 can be enhanced.

The second flow diverting segment 702 may extend vertically, or extend obliquely relative to the horizontal plane. The first flow diverting segment 701 may be connected to a lower end of the second flow diverting segment 702. The first flow diverting segment 701 may extend obliquely downwards from the lower end of the second flow diverting segment 702. Therefore, the upper end of the first flow diverting segment 701 is connected to the lower end of the second flow diverting segment 702. Alternatively, the upper end of the first flow diverting segment 701 may extend upwards beyond the lower end of the second flow diverting segment 702, in which case the upper end of the first flow diverting segment 701 is located above the lower end of the second flow diverting segment 702.

For example, in examples of FIG. 15 and FIG. 16, the flow diverting rib 700 includes the first flow diverting segment 701, the second flow diverting segment 702, and the third flow diverting segment 703. The second flow diverting segment 702 extends vertically. The third flow diverting segment 703 is disposed at the upper end of the second flow diverting segment 702. The third flow diverting segment 703 obliquely extends to the upper end of the second flow diverting segment 702 relative to the horizontal plane from top to bottom. The first flow diverting segment 701 is connected to the lower end of the second flow diverting segment 702, and extends obliquely relative to the horizontal plane from top to bottom. The upper end of the first flow diverting segment 701 is located above the lower end of the second flow diverting segment 702.

When the flow diverting rib 700 includes the first flow diverting segment 701, the second flow diverting segment 702, and the third flow diverting segment 703, the lower end of the second flow diverting segment 702 may also be connected to the upper end of the first flow diverting segment 701.

Figure 14:
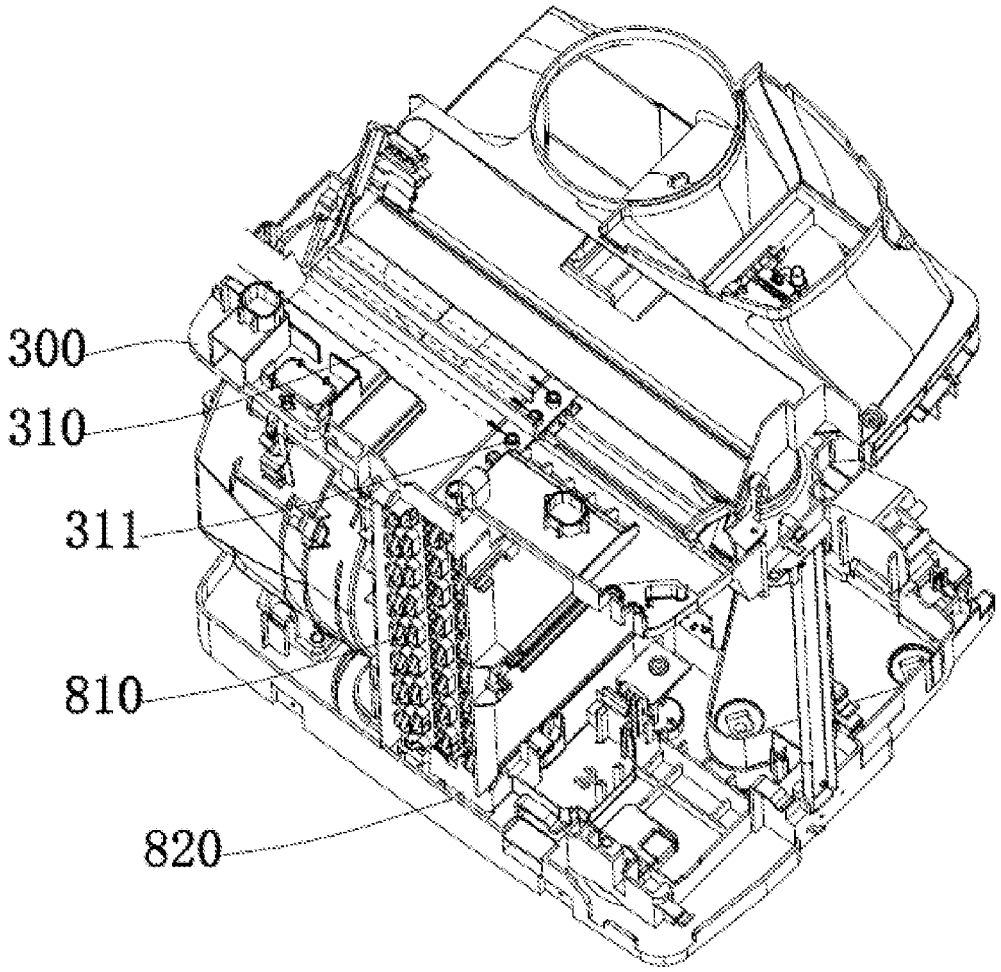
FIG. 14 is a schematic perspective view of an air conditioner with an upper air duct assembly removed according to an embodiment of the present disclosure.

With reference to FIG. 14, in some embodiments of the present disclosure, the mobile air conditioner further includes a lower air duct assembly 800. The intermediate partition plate 300 is disposed between the upper air duct assembly 200 and the lower air duct assembly 800. The lower air duct assembly 800 is disposed below the intermediate partition plate 300 and includes a lower air duct heat exchanger 810. The intermediate partition plate 300 is configured with the fluid receiving tray 310 for receiving the diverted fluid. A drainage hole 311 is defined in a bottom of the fluid receiving tray 310. The drainage hole 311 is located above the lower air duct heat exchanger 810. The flow guide structure 900 is configured to guide the fluid discharged from the flow diverting portion 123 to the intermediate partition plate 300, thus the fluid diverted by the flow diverting portion 123 can be diverted to the fluid receiving tray 310. In addition, in the cooling mode of the air conditioner, the lower air duct heat exchanger 810 is a condenser. The condenser dissipates heat during its operation. The condensed fluid from the fluid receiving tank 400 is discharged to the fluid receiving tray 310 under the diversion, and drips on the lower air duct heat exchanger 810 through the drainage hole 311 at the bottom of the fluid receiving tray 310. Therefore, the condensed fluid can assist the lower air duct heat exchanger 810 in dissipating heat to improve a heat dissipation capacity of the lower air duct heat exchanger 810, which improves energy efficiency of mobile air conditioners and reduces energy consumption of the mobile air conditioner. Therefore, market competitiveness of the mobile air conditioner can be enhanced. In addition, the heat dissipated by the lower air duct heat exchanger 810 evaporates the condensed fluid to eliminate the condensed fluid. Compared with a method for eliminating the condensed fluid by means of disposing the fluid collection tank or an external drainage pipe in the mobile air conditioner, such a method facilitates use of the mobile air conditioner.

It is conceivable that, in some embodiments, the flow guide structure 900 is disposed on an inner side wall of the body. With the flow guide structure 900 disposed on the inner side wall of the body, the fluid from the flow diverting portion can be diverted to the base 820 or other predetermined positions, and details thereof will be omitted herein.

In the description of this specification, descriptions with reference to the terms "an embodiment", "some embodiments", "examples", "specific examples", or "some examples" etc. mean that specific features, structure, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials, or characteristics may be combined in any one or more embodiments or examples in a suitable manner. In addition, different embodiments or examples and features of different embodiments or examples described in the specification may be combined by those skilled in the art without mutual contradiction.

Although the exemplary embodiments of the present disclosure have been shown and described above, it should be understood that the above embodiments are exemplary and should not be construed as limiting the present disclosure. Changes, modifications, substitutions, and alternations can be made to the above embodiments by those skilled in the art within the scope of the present disclosure.

What is claimed is:

1. A panel assembly comprising:

a panel having a fitting hole;

a pressing member disposed on an inner side of the panel, wherein the pressing member comprising a plate body and a button disposed on the plate body, wherein the button extends into the fitting hole; and a display box disposed on a back surface of the panel and opposite to the pressing member, wherein the plate body comprises a flow diverting portion disposed around the button and configured to divert a fluid out of the display box.

2. The panel assembly according to claim 1, wherein the flow diverting portion is disposed on a surface of the plate body facing towards the panel and comprises:

a first flow diverting groove defined around the button; and a second flow diverting groove in communication with the first flow diverting groove and extending to an edge of the plate body through the plate body.

3. The panel assembly according to claim 2, wherein the surface of the plate body is partially hollowed out to define the first flow diverting groove and the second flow diverting groove.

4. The panel assembly according to claim 1, wherein the plate body is attached to an inner surface of the panel.

5. The panel assembly according to claim 1, wherein:

the panel has one or more fitting holes;

one or more buttons are provided in one-to-one correspondence with the one or more fitting holes; and the flow diverting portion is provided for each of the one or more buttons and disposed around each of the one or more buttons.

6. The panel assembly according to claim 1, wherein the pressing member is formed into a flexible integrated plate shape.

7. The panel assembly according to claim 1, wherein an accommodation groove is defined on a surface of the display box facing towards the panel, the pressing member being embedded in the accommodation groove.

8. The panel assembly according to claim 1, wherein:

one of the plate body and the display box has a positioning post, and the other one of the plate body and the display box has a positioning hole, the positioning post being inserted into the positioning hole.

9. The panel assembly according to claim 1, wherein:

the display box has a display region; and a part of the panel directly opposite to the display region is thinned to form a thinned region.

10. The panel assembly according to claim 1, wherein a limiting rib is disposed on the panel and abuts against a side edge of the display box.

11. The panel assembly according to claim 9, wherein:

the plate body comprises a first plate portion, a connection portion, and a second plate portion that are connected sequentially in a length direction of the plate body;

the display box has a first recess, a communication groove portion, and a second recess, wherein the first recess, the communication groove portion and the second recess are communicated sequentially in a length direction of the display box, the first plate portion being embedded in the first recess, the second plate portion being embedded in the second recess, and the connection portion being embedded in the communication groove portion;

the button is disposed on each of the first plate portion and the second plate portion; and the display region comprises a digital display region and a lighting region, the lighting region being opposite to the button in a width direction of the plate body, and the digital display region being located between the first recess and the second recess in the length direction of the plate body.

12. The panel assembly according to claim 1, wherein:

two ends of the display box in a length direction of the display box are fixedly connected to the panel; and the pressing member is fixedly clamped through engagement of the display box with the panel.

13. An air conditioner comprising:

a body; and the panel assembly according to claim 1, wherein the panel assembly is disposed on the body.

14. The air conditioner according to claim 13, wherein:

the air conditioner comprises a mobile air conditioner;

the panel assembly is disposed on an upper part of the body; and a flow guide structure is disposed in the body, and configured to guide a fluid discharged from the flow diverting portion into a predetermined position.

15. The air conditioner according to claim 14, wherein an upper air duct assembly is disposed in the body, the upper air duct assembly comprising:

an upper air duct heat exchanger;

a scroll housing, the flow guide structure being disposed on the scroll housing; and an upper air duct fan disposed in the scroll housing.

16. The air conditioner according to claim 15, wherein the flow guide structure comprises:

a fluid receiving tank disposed between the scroll housing and an outer wall surface of an air outlet of the upper air duct assembly and extending in a length direction of the air outlet, the fluid receiving tank being adapted to receive the fluid discharged from the flow diverting portion, and a drainage portion being disposed on at least one end of the fluid receiving tank; and a fluid diverting structure disposed on a side wall of the scroll housing, the fluid diverting structure having an upper part configured to joint with a corresponding drainage portion and a lower part configured to divert the fluid into the predetermined position, wherein the fluid diverting structure comprises at least one of a fluid diverting groove or a flow diverting rib.

17. The air conditioner according to claim 16, wherein:

the fluid diverting structure is configured to comprise the flow diverting rib; and the flow diverting rib comprises a first flow diverting segment extending obliquely towards the predetermined position relative to a horizontal plane; and/or the flow diverting rib comprises a second flow diverting segment extending towards the predetermined position and a third flow diverting segment disposed on an upper end of the second diverting segment, the third flow diverting segment extending obliquely towards the second flow diverting segment relative to a horizontal plane to divert the fluid discharged from the drainage portion to the second flow diverting segment.

18. The air conditioner according to claim 17, wherein when the flow diverting rib comprises the first flow diverting segment, the second diverting segment, and the third flow diverting segment, the first flow diverting segment is disposed at a lower side of the second flow diverting segment to divert a fluid flowing through the second flow diverting segment into the predetermined position.

19. The air conditioner according to claim 16, wherein a sealing plate is disposed on the scroll housing, the fluid receiving tank being disposed on the sealing plate, and a fluid retaining rib being disposed on the sealing plate.

20. The air conditioner according to claim 15, further comprising a lower air duct assembly, wherein:

an intermediate partition plate is disposed between the lower air duct assembly and the upper air duct assembly;

the flow guide structure is configured to guide the fluid discharged from the flow diverting portion to the intermediate partition plate;

the lower air duct assembly comprises a lower air duct heat exchanger; and the intermediate partition plate has a drainage hole located above the lower air duct heat exchanger.

* * * * *